US008136234B2

(12) United States Patent
Islam

(10) Patent No.: US 8,136,234 B2
(45) Date of Patent: Mar. 20, 2012

(54) FLARING COAXIAL CABLE END PREPARATION TOOL AND ASSOCIATED METHODS

(75) Inventor: Nahid Islam, Westmont, IL (US)

(73) Assignee: Andrew LLC, Hickory, NC (US)

( * ) Notice: Subject to any disclaimer, the term of this patent is extended or adjusted under 35 U.S.C. 154(b) by 437 days.

(21) Appl. No.: 12/277,152

(22) Filed: Nov. 24, 2008

(65) Prior Publication Data

US 2010/0126011 A1 May 27, 2010

(51) Int. Cl.
*H01R 43/22* (2006.01)

(52) U.S. Cl. ..... 29/747; 29/748; 29/828; 30/90.1

(58) Field of Classification Search ..... 29/747–748, 29/752, 828, 564.2, 242; 30/90.1–90.8; 81/9.4
See application file for complete search history.

(56) References Cited

U.S. PATENT DOCUMENTS

| | | | | |
|---|---|---|---|---|
| 3,040,288 | A | 6/1962 | Edlen et al. | 339/103 |
| 3,103,548 | A | 9/1963 | Concelman | 174/89 |
| 3,106,599 | A | 10/1963 | Leitner et al. | 174/12 |
| 3,671,926 | A | 6/1972 | Nepovim | 339/177 E |
| 3,744,011 | A | 7/1973 | Blanchenot | 339/177 R |
| 3,757,279 | A | 9/1973 | Winston | 339/177 R |
| 3,761,870 | A | 9/1973 | Drezin et al. | 339/177 R |
| 3,847,463 | A | 11/1974 | Hayward et al. | 339/8 P |
| 3,915,539 | A | 10/1975 | Collins | 339/94 C |
| 4,046,451 | A | 9/1977 | Juds et al. | 339/177 R |
| 4,491,685 | A | 1/1985 | Drew et al. | 174/75 C |
| 4,557,546 | A | 12/1985 | Dreyer | 339/177 R |
| 4,585,289 | A | 4/1986 | Bocher | 339/89 C |
| 4,676,577 | A | 6/1987 | Szegda | 439/584 |
| 4,915,651 | A | 4/1990 | Bout | 439/578 |
| 4,923,412 | A | 5/1990 | Morris | 439/578 |
| 4,979,299 | A * | 12/1990 | Bieganski | 30/90.1 |
| 5,009,130 | A * | 4/1991 | Bieganski | 81/9.4 |
| 5,105,542 | A * | 4/1992 | Nakajima et al. | 30/90.1 |
| 5,137,470 | A | 8/1992 | Doles | 439/578 |
| 5,154,636 | A | 10/1992 | Vaccaro et al. | 439/583 |
| 5,267,877 | A | 12/1993 | Scannelli et al. | 439/584 |
| 5,281,167 | A | 1/1994 | Le et al. | 439/578 |
| 5,352,127 | A | 10/1994 | Muller et al. | 439/188 |
| 5,352,134 | A | 10/1994 | Jacobsen et al. | 439/584 |
| 5,509,821 | A | 4/1996 | Small et al. | 439/272 |

(Continued)

OTHER PUBLICATIONS

U.S. Appl. No. 12/277,103, filed Nov. 24. 2008, Islam.

(Continued)

*Primary Examiner* — Minh Trinh

(74) *Attorney, Agent, or Firm* — Allen, Dyer, Doppelt, Milbrath & Gilchrist, P.A. Attorneys at Law

(57) ABSTRACT

A cable end preparation tool is for a coaxial cable having an inner conductor, an outer conductor, and a dielectric therebetween. The cable end preparation tool includes a body and a blade carried by the body for removing a portion of the dielectric between the inner conductor and the outer conductor when the body is rotated about the coaxial cable. A first projection is carried by the body and has a predetermined shape for flaring an end portion of the outer conductor when the body is rotated relative to the coaxial cable. A second projection is movable with respect to the body between an outer conductor engaging position and a disengaged position, the second projection for corrugating the flared end portion of the outer conductor when in the outer conductor engaging position and the body is rotated relative to the coaxial cable.

13 Claims, 24 Drawing Sheets

U.S. PATENT DOCUMENTS

| | | | | |
|---|---|---|---|---|
| 5,511,305 | A * | 4/1996 | Garner | 29/828 |
| 5,545,059 | A | 8/1996 | Nelson | 439/583 |
| 5,576,675 | A | 11/1996 | Oldfield | 333/260 |
| 5,722,856 | A | 3/1998 | Fuchs et al. | 439/578 |
| 5,785,554 | A | 7/1998 | Ohshiro | 439/584 |
| 5,795,188 | A | 8/1998 | Harwath | 439/583 |
| 5,830,009 | A | 11/1998 | Tettinger | 439/578 |
| 5,938,474 | A | 8/1999 | Nelson | 439/583 |
| 5,992,010 | A * | 11/1999 | Zamanzadeh | 29/747 |
| 6,019,636 | A | 2/2000 | Langham | 439/584 |
| 6,109,964 | A | 8/2000 | Kooiman | 439/583 |
| 6,131,289 | A * | 10/2000 | Tarpill | 30/90.6 |
| 6,133,532 | A | 10/2000 | Lundback et al. | 174/88 C |
| 6,148,513 | A | 11/2000 | Schiefer et al. | 29/858 |
| 6,203,368 | B1 | 3/2001 | Weidner | 439/579 |
| 6,267,621 | B1 | 7/2001 | Pitschi et al. | 439/584 |
| 6,309,250 | B1 | 10/2001 | Hyzin | 439/578 |
| 6,332,808 | B1 | 12/2001 | Kanda et al. | 439/584 |
| 6,386,915 | B1 | 5/2002 | Nelson | 439/584 |
| 6,396,367 | B1 | 5/2002 | Rosenberger | 333/260 |
| 6,427,331 | B1 * | 8/2002 | Tarpill et al. | 30/90.8 |
| 6,439,924 | B1 | 8/2002 | Kooiman | 439/578 |
| 6,462,637 | B1 | 10/2002 | Laverick | 336/107 |
| 6,607,398 | B2 | 8/2003 | Henningsen | 439/578 |
| 6,637,101 | B2 * | 10/2003 | Hathaway et al. | 29/829 |
| 6,668,459 | B2 | 12/2003 | Henningsen | 30/90.2 |
| 6,692,300 | B2 | 2/2004 | Kanda et al. | 439/583 |
| 6,793,529 | B1 | 9/2004 | Buenz | 439/583 |
| 6,802,739 | B2 | 10/2004 | Henningsen | 439/584 |
| 6,808,415 | B1 | 10/2004 | Montena | 439/584 |
| 6,824,415 | B2 | 11/2004 | Wlos | 439/348 |
| 6,835,095 | B2 | 12/2004 | Chen | 439/578 |
| 6,848,931 | B2 | 2/2005 | McMullen et al. | 439/350 |
| 6,848,939 | B2 | 2/2005 | Stirling | 439/578 |
| 6,848,941 | B2 | 2/2005 | Wlos et al. | 439/585 |
| 6,863,565 | B1 | 3/2005 | Kogan et al. | 439/580 |
| 6,893,290 | B2 | 5/2005 | Buenz et al. | 439/578 |
| 6,926,555 | B2 | 8/2005 | Nelson | 439/578 |
| 6,939,169 | B2 | 9/2005 | Islam et al. | 439/578 |
| 7,008,264 | B2 | 3/2006 | Wild | 439/578 |
| 7,011,546 | B2 | 3/2006 | Vaccaro | 439/580 |
| 7,059,162 | B1 | 6/2006 | Tarpill et al. | 72/112 |
| 7,077,700 | B2 | 7/2006 | Henningsen | 439/583 |
| 7,104,839 | B2 | 9/2006 | Henningsen | 439/578 |
| 7,121,883 | B1 | 10/2006 | Petersen et al. | 439/582 |
| 7,134,189 | B2 | 11/2006 | Buenz et al. | 29/748 |
| 7,144,272 | B1 | 12/2006 | Burris et al. | 439/578 |
| 7,156,696 | B1 | 1/2007 | Montena | 439/584 |
| 7,163,420 | B2 | 1/2007 | Montena | 439/578 |
| 7,171,753 | B2 * | 2/2007 | Korczak et al. | 30/90.1 |
| 7,179,121 | B1 | 2/2007 | Burris et al. | 439/578 |
| 7,329,149 | B2 | 2/2008 | Montena | 439/584 |
| 7,335,059 | B2 | 2/2008 | Vaccaro | 439/578 |
| 7,381,089 | B2 | 6/2008 | Hosler, Sr. | 439/578 |
| 7,422,477 | B2 | 9/2008 | Eriksen | 439/578 |
| 7,435,135 | B2 | 10/2008 | Wlos | 439/584 |
| 7,448,906 | B1 | 11/2008 | Islam | 439/578 |
| 7,621,778 | B1 | 11/2009 | Paynter | 439/583 |
| 7,632,143 | B1 | 12/2009 | Islam | 439/583 |
| 7,635,283 | B1 | 12/2009 | Islam | 439/583 |
| 7,694,420 | B2 * | 4/2010 | Ehret et al. | 30/90.1 |
| 7,727,013 | B1 | 6/2010 | Paynter | 439/578 |
| 7,731,529 | B1 | 6/2010 | Islam | 439/583 |
| 7,785,144 | B1 | 8/2010 | Islam | 439/583 |
| 7,798,847 | B2 | 9/2010 | Islam | 439/578 |
| 7,798,848 | B2 | 9/2010 | Islam | 439/584 |
| 7,806,724 | B2 | 10/2010 | Paynter | 439/578 |
| 7,824,214 | B2 | 11/2010 | Paynter | 439/578 |
| 7,824,215 | B2 | 11/2010 | Islam | 439/578 |
| 2005/0118865 | A1 | 6/2005 | Henningsen | 439/578 |
| 2006/0112549 | A1 | 6/2006 | Henningsen | 29/857 |
| 2007/0149047 | A1 | 6/2007 | Wild et al. | 439/578 |
| 2009/0053931 | A1 * | 2/2009 | Islam | 439/578 |
| 2009/0186521 | A1 | 7/2009 | McMullen et al. | 439/578 |

OTHER PUBLICATIONS

U.S. Appl. No. 12/277,125, filed Nov. 24, 2008, Islam.
U.S. Appl. No. 12/277,162, filed Nov. 24, 2008, Islam.
U.S. Appl. No. 12/277,172, filed Nov. 24, 2008, Islam.*
U.S. Appl. No. 12/361,241, filed Jan. 28, 2000, Islam.*
Paynter, "Coupling Nut With Cable Jacket Retention," Jun. 29, 2008, pp. 1-20.
Paynter, "Coaxial Connector Inner Contact Arrangement," Jul. 15, 2008, pp. 1-17.
Islam, "Inner Conductor Sealing Insulator for Coaxial Connector," Oct. 7, 2008, pp. 1-17.
Paynter, "Insertion Coupling Coaxial Connector," Nov. 3, 2008, pp. 1-24.
Islam, "Axial Compression Connector," Nov. 3, 2008, pp. 1-25.
Islam, "Connector With Positive Stop for Coaxial Cable and Associated Methods," Nov. 24, 2008, pp. 1-22.
Islam, "Connector Including Compressible Ring for Coaxial Cable and Associated Methods," Nov. 24, 2008, pp. 1-30.
Islam, "Connector With Positive Stop and Compressible Ring for Coaxial Cable and Associated Methods," Nov. 24, 2008, pp. 1-25.
Islam, "Connector With Retaining Ring for Coaxial Cable and Associated Methods," Nov. 24, 2008, pp. 1-28.
Islam, "Connector Including Flexible Fingers and Associated Methods," Jan. 28, 2009, pp. 1-26.
Paynter, "Low PIM Rotatable Connector," Jan. 29, 2009, pp. 1-17.
Islam, "Inner Contact Supporting and Biasing Insulator," Jan. 29, 2009, pp. 1-16.

* cited by examiner

FLARING COAXIAL CABLE END PREPARATION TOOL AND ASSOCIATED METHODS

FIELD OF THE INVENTION

The present invention relates to the field of tools for the preparation of cable ends, and, more particularly, to tool for the preparation of coaxial cable ends and related methods.

BACKGROUND OF THE INVENTION

Coaxial cables are widely used to carry high frequency electrical signals. Coaxial cables enjoy a relatively high bandwidth, low signal losses, are mechanically robust, and are relatively low cost. One particularly advantageous use of a coaxial cable is for connecting electronics at a cellular or wireless base station to an antenna mounted at the top of a nearby antenna tower. For example, the transmitter located in an equipment shelter may be connected to a transmit antenna supported by the antenna tower. Similarly, the receiver is also connected to its associated receiver antenna by a coaxial cable path.

A typical installation includes a relatively large diameter coaxial cable extending between the equipment shelter and the top of the antenna tower to thereby reduce signal losses. Some coaxial cables include a smooth outer conductor while other coaxial cables instead have a corrugated outer conductor. These coaxial cables also have an inner conductor and a dielectric between the outer conductor and the inner conductor. Some inner conductors are hollow, while other inner conductors are formed around an inner conductor dielectric core.

A typical connector for such a coaxial cable includes a connector housing to make an electrical connection to the outer conductor and a center contact to make electrical connection to the inner conductor of the coaxial cable. Such a connector may also include a back nut that is positioned onto the end of the outer conductor and adjacent the outer insulating jacket portion of the coaxial cable.

Installation of coaxial cable connectors generally requires that a technician cut and prepare the coaxial cable ends at the appropriate location to mount the connector thereon. In particular, the cable end preparation requires removal of the outer jacket to expose a portion of the outer conductor, as well as removal of the outer conductor and dielectric layer to expose a portion of the inner conductor. Moreover, the exposed portion of the outer conductor may also require flaring. However, performing these operations can be difficult given the diameter of some coaxial cables, and the use of knives or other basic cutting tools with exposed blades may create a risk of injury to the technician. Moreover, a technician may be required to install connectors while at the top a cell tower, which compounds the difficulties of preparing a cable end with basic cutting tools.

As a result, various cable preparation tools have been developed to make coaxial cable end preparation easier for installation technicians. One such example is set forth in U.S. Pat. No. 6,668,459 to Henningsen. This patent describes stripping tools for coaxial cables with a corrugated outer conductor and a hollow inner conductor. The tool includes three main parts: a jacket cutting part for removing a certain predetermined length of the jacket of the cable, a guide part to be placed around the end of the cable after the jacket has been removed by the jacket cutting part, and a second cutting part to be placed on the guide part during a final preparation of the end of the cable during which the inner conductor, the outer conductor and the dielectric material between inner and outer conductor are cut to appropriate lengths. The guide part is provided with a portion for determining a well-defined longitudinal position of the tool on the cable relative to the pattern of valleys and crests of the corrugation on the outer conductor.

An exemplary cable flaring tool is described in U.S. Pat. No. 7,059,162 to Tarpill et al. The flaring tool is for flaring the outer conductors of two different sizes of coaxial cable, and it includes a dome-shaped body and a reversible tool head. The tool head has first and second shafts and first and second flaring heads on opposite sides. Reversing the tool head exposes the shaft and flaring head for the corresponding size of coaxial cable. The shafts match the inner diameter of the inner conductor of the coaxial cable to be flared. The flaring heads are shaped as half cones, which allow the outer conductor to be flared without deforming the insulation between the inner and outer conductors of the coaxial cable.

U.S. Pat. Pub. 2006/0112549 to Henningsen discloses a tool for preparing the end of a coaxial cable. The tool comprises an outer body with a cylindrical bore for receiving an end of the coaxial cable. The tool includes a jacket removing member secured to the outer body and directed to the cylindrical bore for removing a portion of the jacket of the coaxial cable as the outer body is rotated relative to the coaxial cable. The tool also includes a coring member for removing a portion of the dielectric surrounding the inner conductor as the outer body is rotated relative to the coaxial cable.

Despite the existence of such stripping and flaring tools, further advancements in coaxial cable end preparation tools and methods may be desirable. For example, tools such as those noted above may not each be able to prepare a coaxial cable for use with different types of connectors. Moreover, tools that can be used without the assistance of a power driver, such as a cordless drill, may also be helpful to technicians.

SUMMARY OF THE INVENTION

In view of the foregoing background, it is therefore an object of the present invention to provide a manually operated coaxial cable end preparation tool able to prepare the end of a coaxial cable for use with a variety of different connectors.

This and other objects, features, and advantages in accordance with the present invention are provided by a cable end preparation tool for a coaxial cable comprising an inner conductor, an outer conductor, and a dielectric therebetween. The cable end preparation tool comprises a body and a blade carried by the body for removing a portion of the dielectric between the inner conductor and the outer conductor when the body is rotated about the coaxial cable.

A first projection may be carried by the body and may have a predetermined shape for flaring an end portion of the outer conductor when the body is rotated relative to the coaxial cable. The first projection may have an outwardly extending portion with a predetermined shape for beginning flaring of an end portion of the outer conductor when the body is rotated relative to the coaxial cable.

The cable end preparation tool also includes a second projection being movable with respect to the body between an outer conductor engaging position and a disengaged position. The second projection is for corrugating the flared end portion of the outer conductor when in the outer conductor engaging position and the body is rotated relative to the coaxial cable. This corrugation may advantageously prepare a smooth wall coaxial cable to be used with connectors designed for use with corrugated coaxial cables.

The second projection may comprise a base and a forming tip carried thereby. The base may be pivotally connected to the body. This may advantageously allow the base to be pivoted to the disengaged position for use of the cable end preparation tool when corrugating the outer conductor of the cable is not desired.

Furthermore, the body may have a disk shape. The body may have a central opening therein. Alternatively, a central rotation guide may be carried by the body. The body may have first and second opposing sides. The blade and the first projection may be carried by the first side. Alternatively, the blade may be carried by the first side and the first projection may be carried by the second side.

The body may have a blade access opening defined therein adjacent the cutting blade for receiving the portion of the dielectric between the inner conductor and the outer conductor removed by said cutting blade. The coaxial cable may further comprise an adhesive layer between the outer conductor and the dielectric and the first projection may remove a portion of the adhesive layer when the body is rotated relative to the coaxial cable. Removal of the adhesive layer may provide for a better electrical contact between the outer conductor and a connector. Also, the blade, first projection, and second projection may be removably mounted to the body. The body may have a gripping surface. The blade, the first projection, and the second projection may be integrally formed as a monolithic unit.

Another aspect is directed to a method of preparing an end of a coaxial cable comprising an inner conductor, an outer conductor, and a dielectric therebetween, using a cable end preparation tool. The method comprises positioning the cable end preparation tool adjacent the coaxial cable end and removing a portion of the dielectric with a blade carried by a body of the cable end preparation tool by rotating the body relative to the coaxial cable. Further, the method includes flaring an end portion of the outer conductor with a first projection carried by the body by rotating the body relative to the coaxial cable. In addition, the method includes corrugating the flared end portion of the outer conductor with a second projection carried by the body and being movable with respect to the body between an outer conductor engaging position and a disengaged position by rotating the body relative to the coaxial cable when the second projection is in the outer conductor engaging position.

DETAILED DESCRIPTION OF THE PREFERRED EMBODIMENTS

Figure 1:
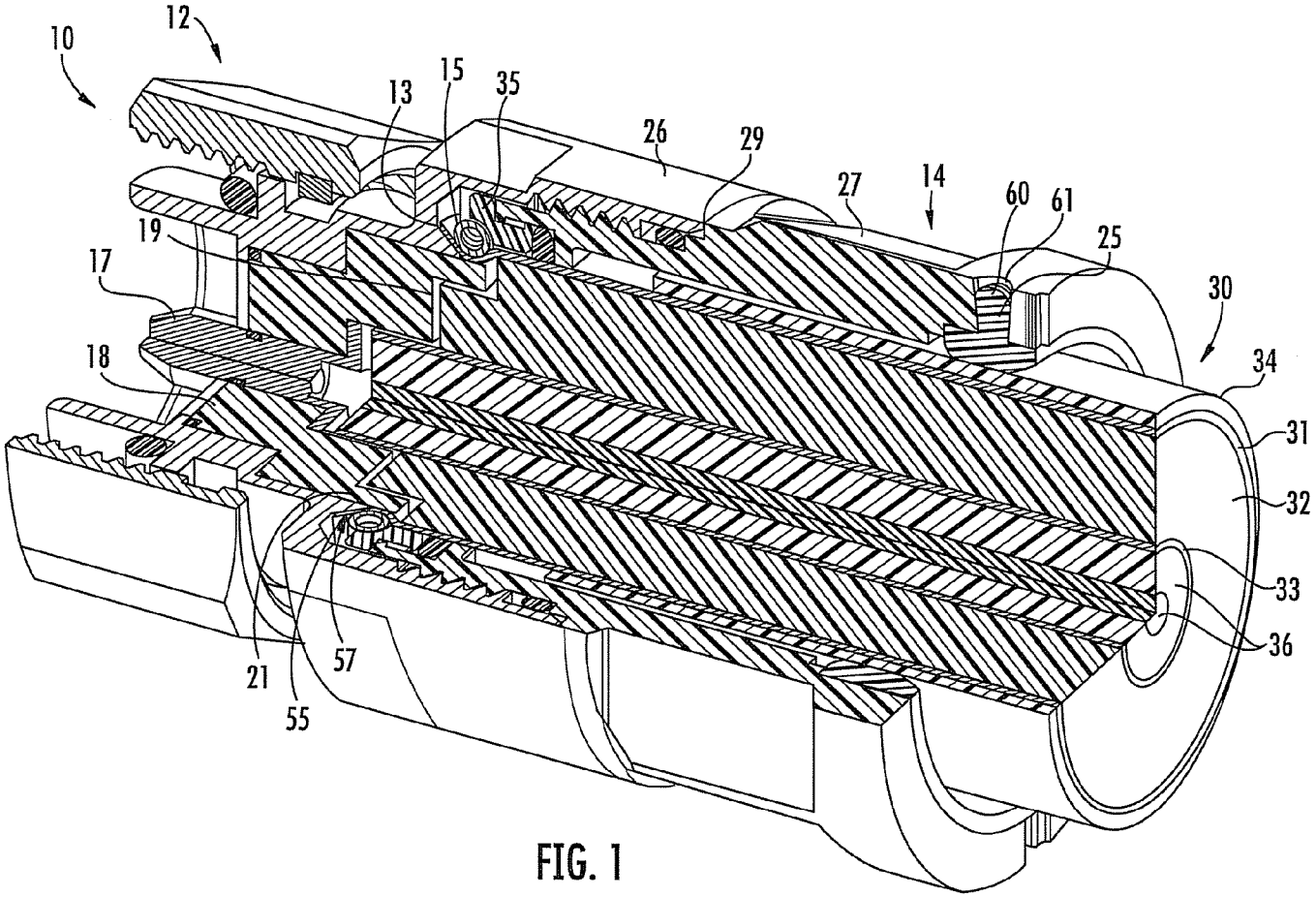
FIG. 1 is a perspective cutaway view of a connector installed on the end of a coaxial cable having a smooth outer conductor in accordance with the present invention.
Figure 2:
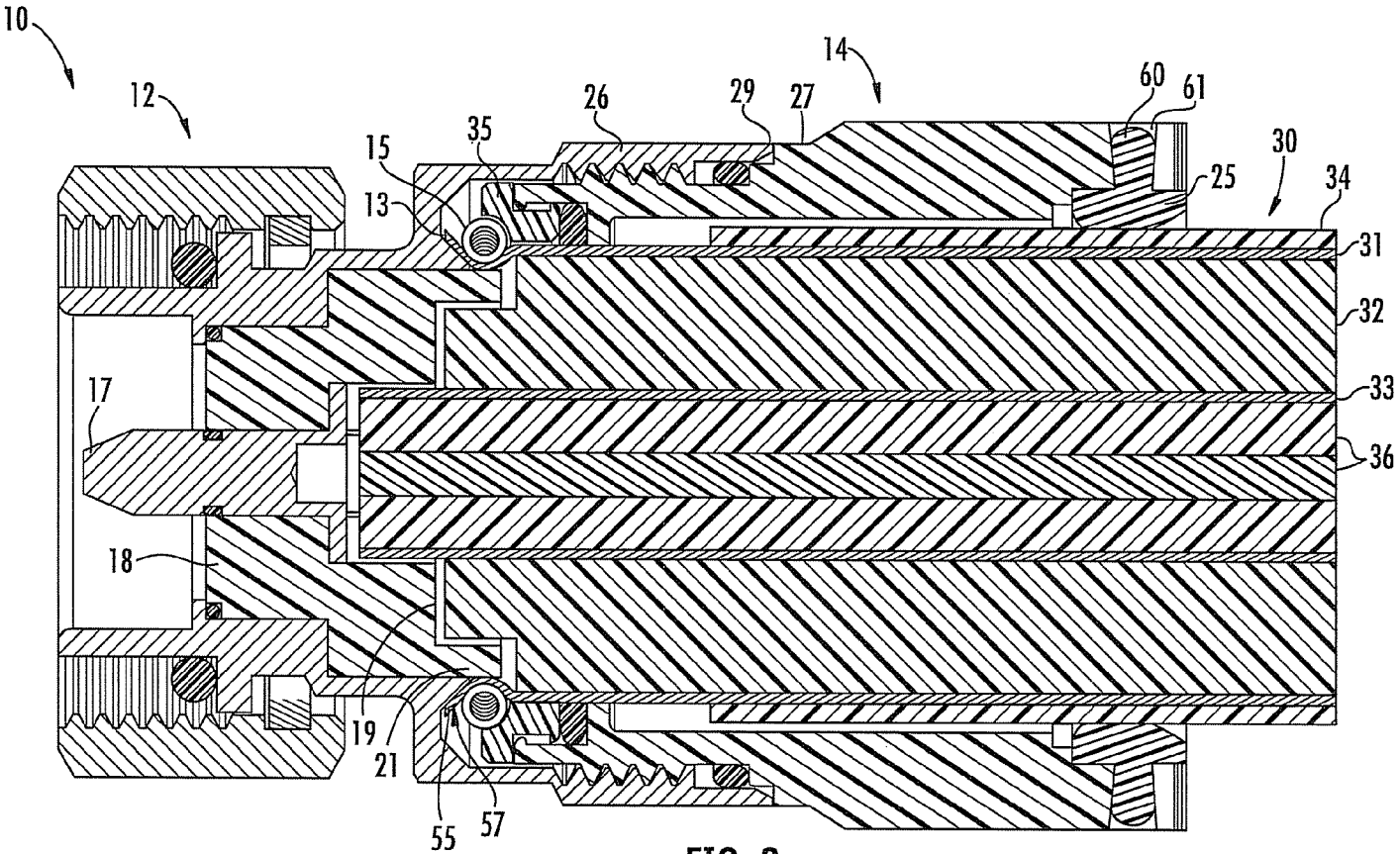
FIG. 2 is a longitudinal cross-sectional view of the connector of FIG. 1.
Figure 3:
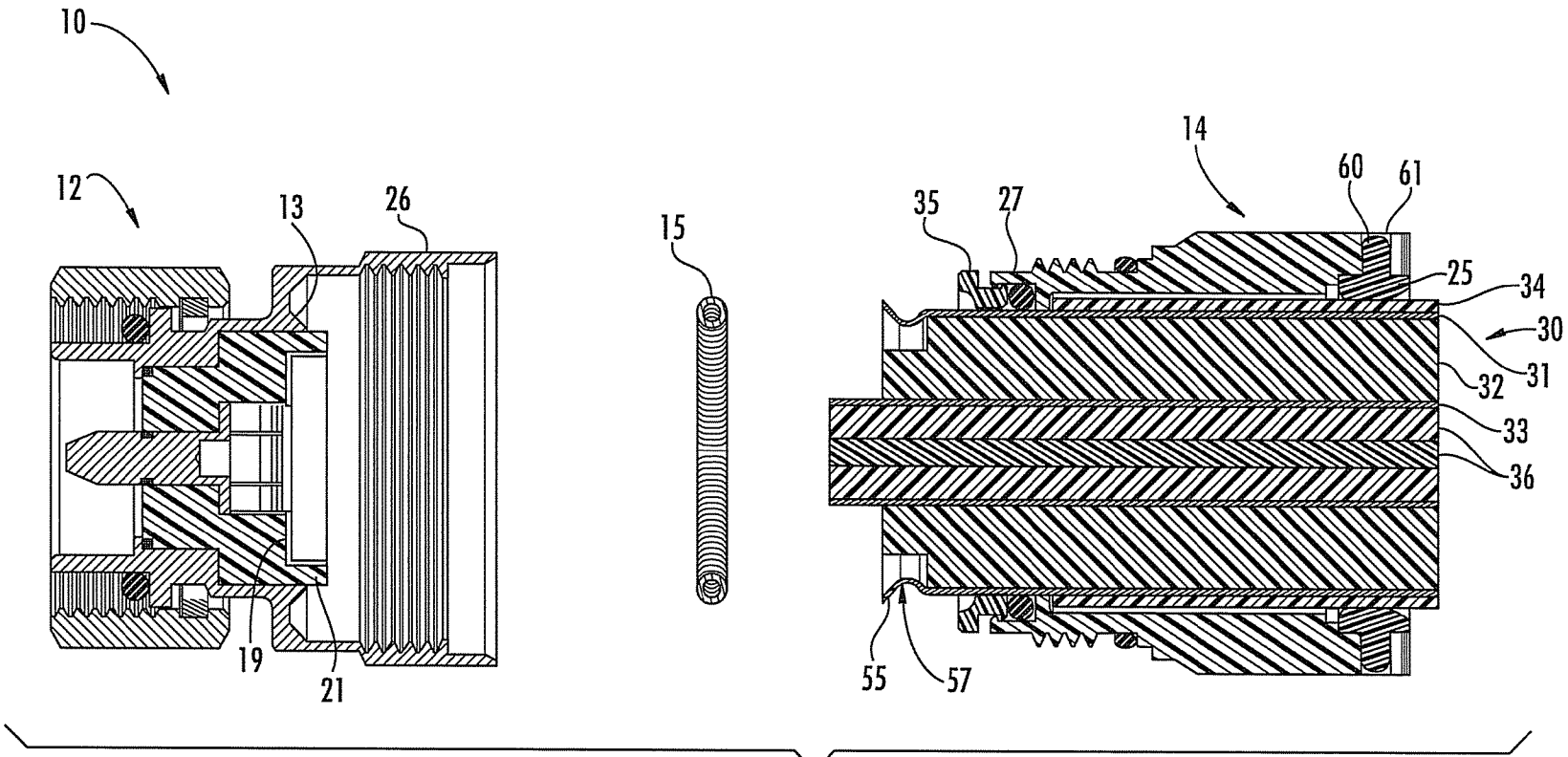
FIG. 3 is an exploded cross-sectional view of the connector of FIG. 1.
Figure 4:
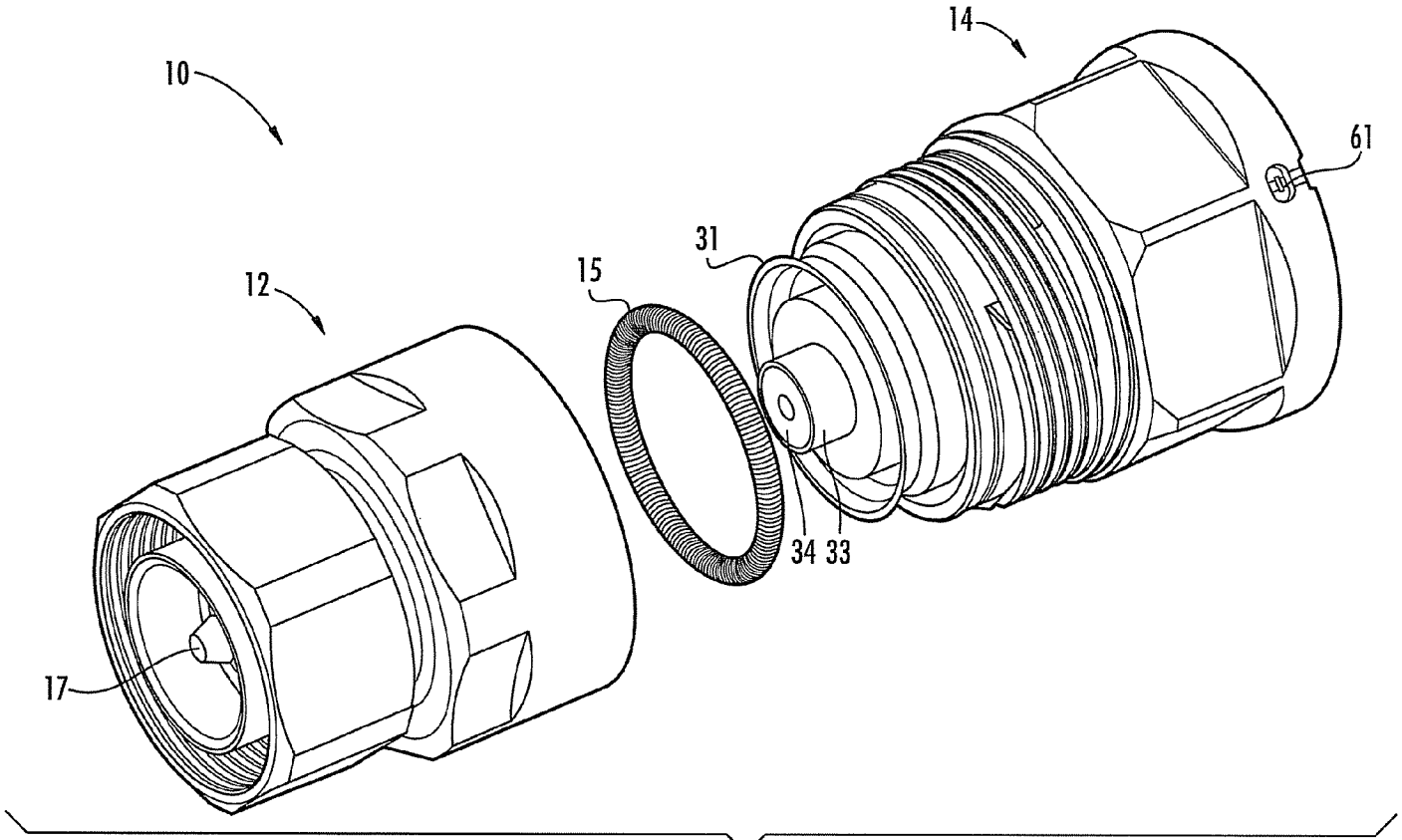
FIG. 4 is an exploded view of the connector of FIG. 1.
Figure 5:
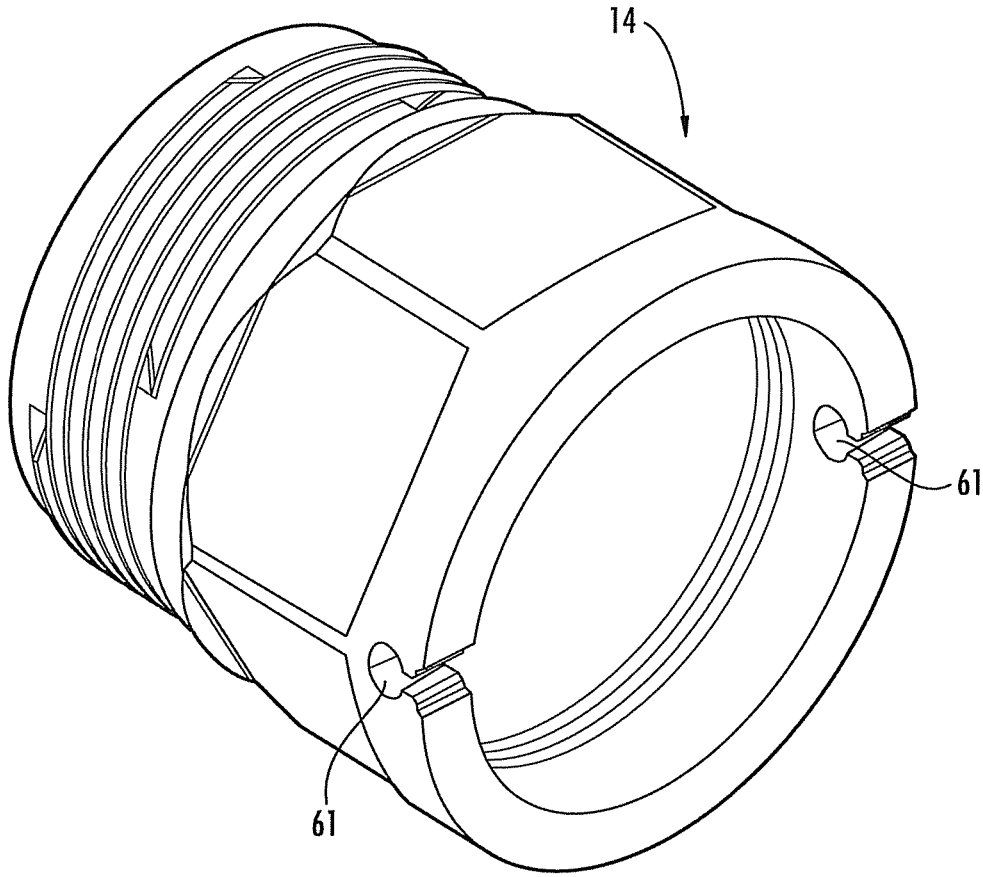
FIG. 5 is a perspective view of the back nut of FIG. 1 not installed on the end of the coaxial cable.

The present invention will now be described more fully hereinafter with reference to the accompanying drawings, in which preferred embodiments of the invention are shown. This invention may, however, be embodied in many different forms and should not be construed as limited to the embodiments set forth herein. Rather, these embodiments are provided so that this disclosure will be thorough and complete, and will fully convey the scope of the invention to those skilled in the art. Like numbers refer to like elements throughout, and prime and multiple prime notation are used to indicate similar elements in alternative embodiments.

Referring initially to FIG. 1-4, a connector 10 to be attached to a coaxial cable 30 is now described. The coaxial cable 30 comprises an inner conductor 33, an outer conductor 31, and a dielectric 32 therebetween. The inner conductor 33 is illustratively a hollow inner with an inner conductor dielectric core 36. The outer conductor 31 is illustratively a smooth outer conductor with a corrugated end 57, but could be a corrugated outer conductor in other embodiments. The dielectrics 32, 36 may be foam dielectrics or other dielectric as known to those skilled in the art.

The end of the coaxial cable 30 is prepared so that the inner conductor 33 extends longitudinally outwardly beyond the end of the outer conductor 31. In addition, portions of the dielectric 32 are removed in a stair-stepped fashion so that the inner surface of the outer conductor 31 is also exposed. The coaxial cable 30 illustratively includes an outer insulation jacket 34 stripped back a distance so that outer end portions of the outer conductor 31 are exposed. The outer conductor 31 is flared outwardly to define a flared portion 55. A corrugated portion 56 of the corrugated end 57 of outer conductor 31 illustratively has a diameter less than that of other portions of the outer conductor.

Of course, the skilled artisan will recognize that, in some applications, the coaxial cable 30 may be prepared differently and may not have the corrugated portion 56. Devices and methods for preparing the end of the coaxial cable 30 will be described in detail below.

The connector 10 comprises a connector housing 12 defining a radially outer ramp 13 having a predetermined shape to receive the corrugated end 57 of the outer conductor 31 thereagainst. The radially outer ramp 13 illustratively has a smooth continuous ramp surface, although it should be understood that other ramp surfaces may be used. For example, the radially outer ramp 13 may be a stair-stepped ramp or may be a radiused ramp.

The connector 10 includes an externally threaded back nut 14 threaded into the internally threaded rearward end of the connector housing 12. The back nut 14 illustratively comprises a polymer composite material, although of course in other applications the back nut could comprise a metal. Construction of the back nut 14 from the polymer composite material ensures that contact between the back nut and the outer conductor does not negatively affect intermodulation distortion (IMD). Furthermore, construction of the back nut 14 from a polymer composite material helps prevent galvanic corrosion between the components of the back nut and the coaxial cable 30.

Figure 8:
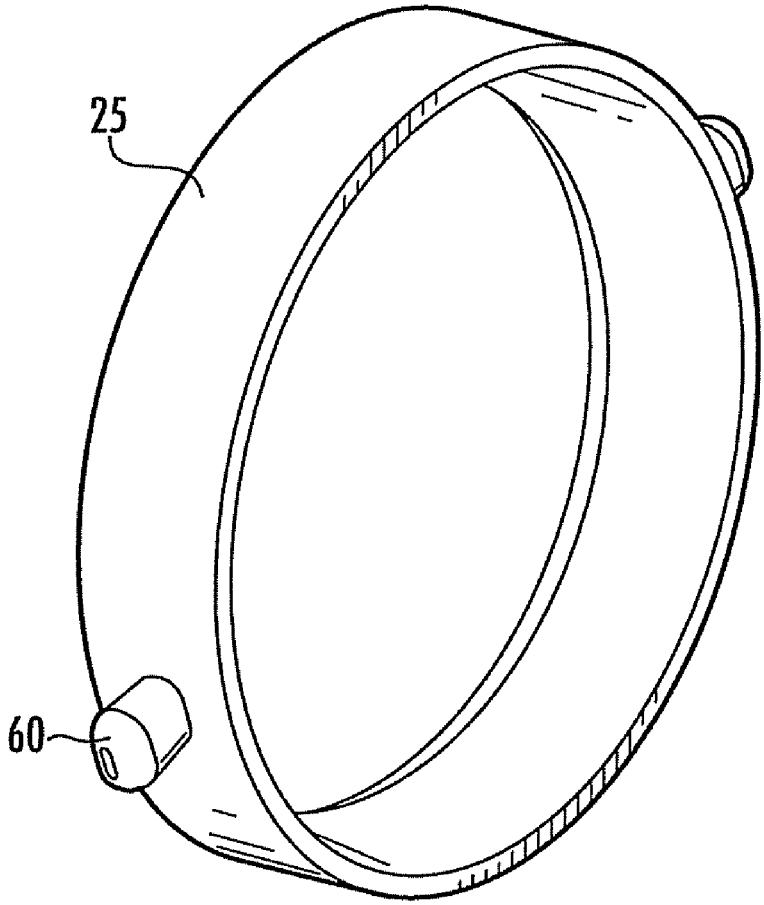
FIG. 8 is a perspective view of the rearward o-ring of the connector of FIG. 1.

A forward o-ring 28 and a rearward o-ring 25 are illustratively provided to seal respective forward and rearward interfaces adjacent the back nut 14 and may prevent moisture ingress, as will be understood by those of skill in the art. As perhaps best shown in FIG. 8, the rearward o-ring 25 has a retaining projection 60 extending outwardly therefrom. This retaining projection is received by recess 61 defined in the back nut 14. The retaining projection 60 and recess 61 securely locate the rearward o-ring 25 in the back nut and help prevent movement of the rearward o-ring during installation of the back nut 14 onto the coaxial cable 30.

A compressible ring 15 compressibly clamps against the outer conductor 31 opposite the radially outer ramp 13 as the connector housing 12 and back nut 14 are engaged. This clamping helps to provide a secure mechanical and electrical connection between the outer conductor 31 and the radially outer ramp 13. By maintaining a secure electrical connection, the intermodulation distortion of signals traveling through the coaxial cable 30 may be reduced.

The compressible ring 15 advantageously maintains a sufficient clamping force on the outer conductor 31 even if the outer conductor changes shape or size due to thermal expansion or creep, for example, whereas an arrangement of two wedging surfaces to clamp the outer conductor might lose clamping force and contact pressure if the outer conductor were to change shape or size. Furthermore, by maintaining a constant clamping force on the outer conductor 31, the compressible ring 15 allows the connector 10 to be used with both smooth wall outer conductor coaxial cables 30 corrugated outer conductor coaxial cables. In addition the compressible ring 15 allows the connector 10 to be used on a variety of coaxial cables with different thicknesses, and on a variety of coaxial cables with outer conductors having different thicknesses.

The compressible ring 15 illustratively comprises an electrically conductive compressible coil spring having an axis coaxial with that of the connector housing 12, although those of skill in the art will appreciate that any suitable compressible ring may be used. In some applications, the compressible ring 15 may not be electrically conductive. Indeed, the compressible ring 15 may be constructed from an electrically conductive material then coated with a non-conductive coating, such as a polymer coating. Alternatively, the compressible ring 15 may be constructed from a non-conductive material.

Figure 6:
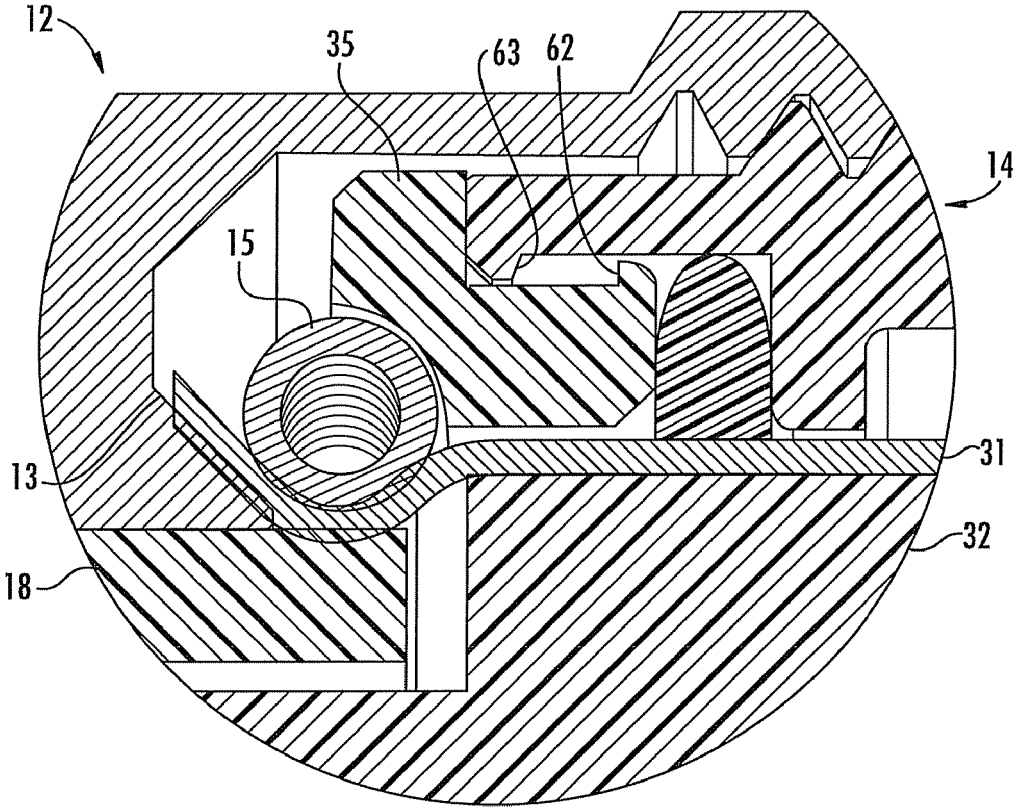
FIG. 6 is a greatly enlarged cross-sectional view of the compressible ring and ferrule of the connector of FIG. 1.
Figure 9:
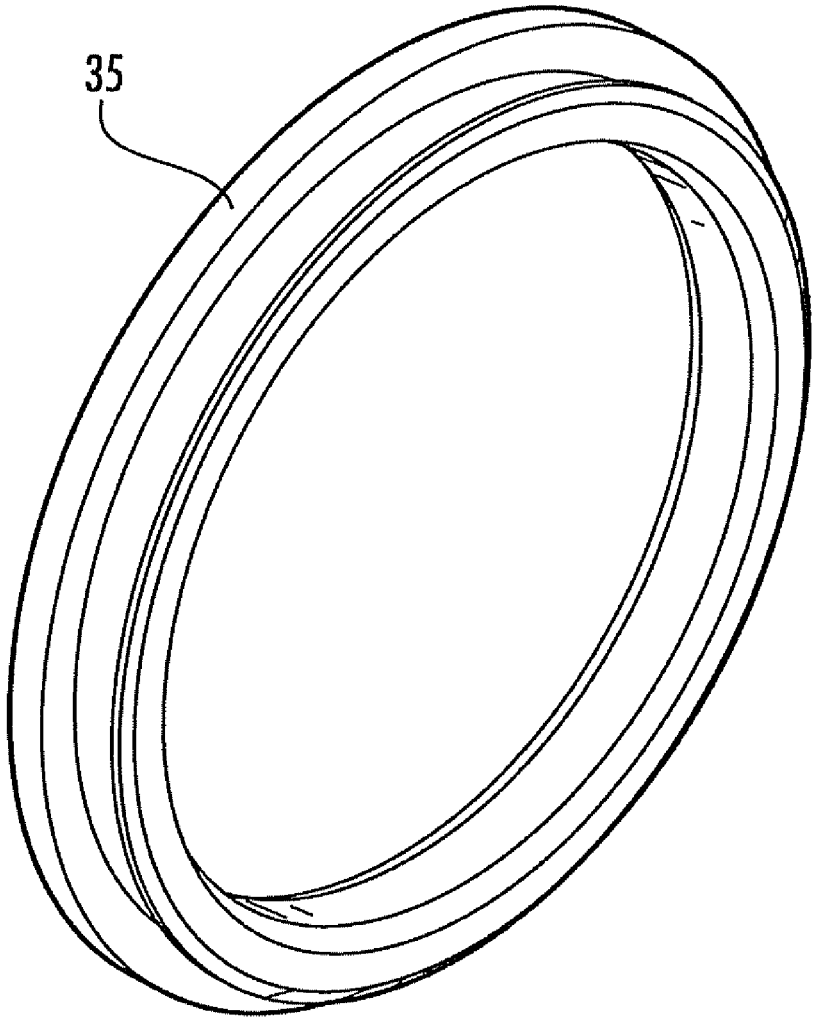
FIG. 9 is a perspective view of the ferrule of the connector of FIG. 1.

The back nut 14 illustratively includes a ferrule 35 (FIGS. 6, 9) to press against the compressible ring 15 as the connector housing 12 and back nut 14 are engaged. The ferrule 35 is illustratively constructed from a polymer composite material, although of course the ferrule may also be constructed from metal and formed by casting or metal injection molding. The ferrule has a retaining projection 62 extending radially outwardly therefrom to engage a retaining projection 63 of the back nut 14. The retaining projections 62, 63 engage when the back nut 14 is advanced axially away from the connector housing 12 so that the ferrule 35 remains in the back nut. Of course, the ferrule 35 is optional and may not be included in all applications.

Figure 7:
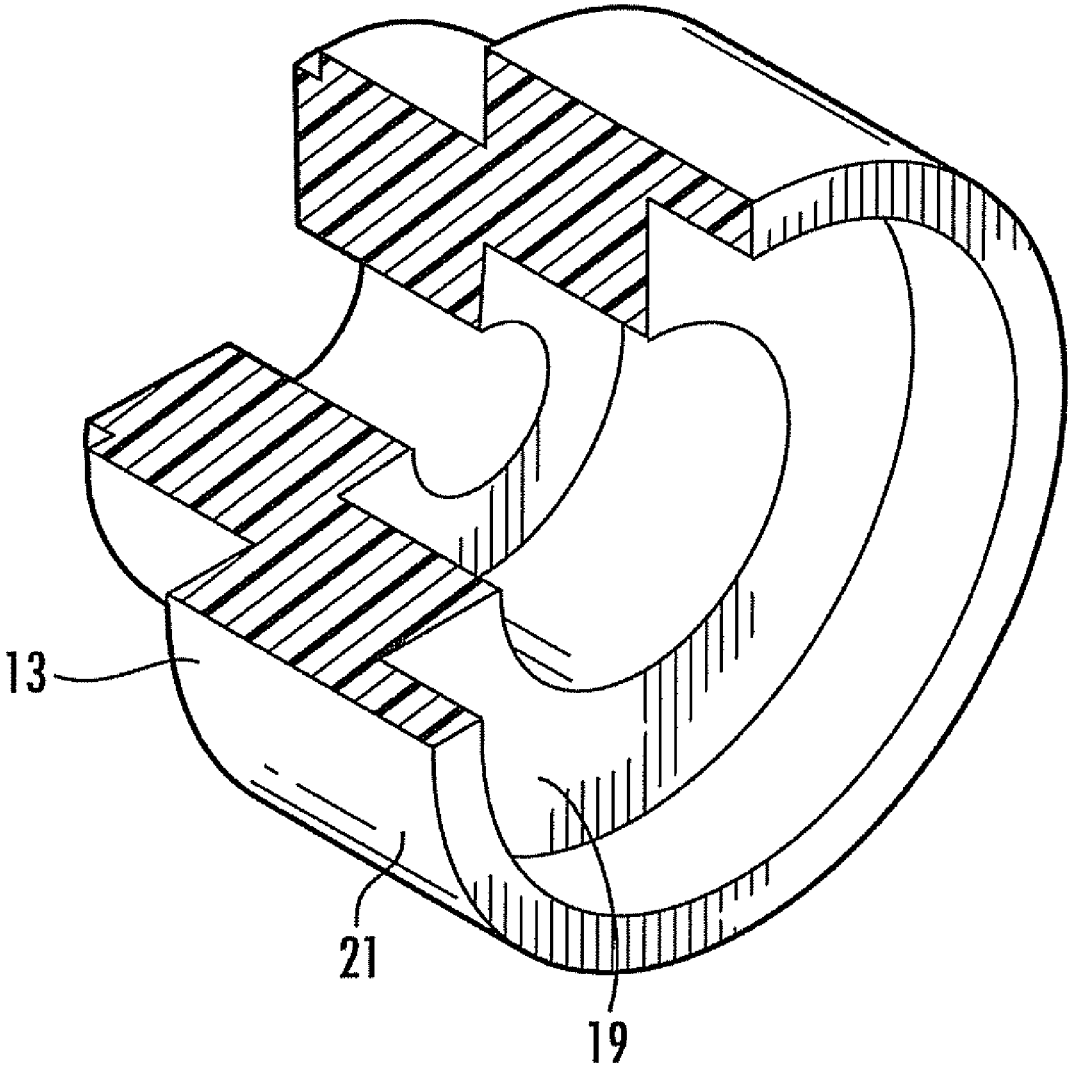
FIG. 7 is a perspective cutaway view of the insulator member of the connector of FIG. 1.

A center contact 17 is supported in the connector housing 12 by an insulator member 18 (FIG. 7) and is electrically connected to the inner conductor 33. The insulator member 18 comprises a radially outer support portion 21 to radially support the outer conductor 31 opposite the compressible ring 15. This radial support supports the outer conductor 31 radially outwardly as the compressible ring 15 urges the outer conductor radially inwardly. Furthermore, the radially outer support portion 21 helps to reduce the chance of a loss of electrical contact between the outer conductor 31 and the radially outer ramp 13 due to flexing of the coaxial cable 30 or due to compression of the dielectric 32.

The insulator member 18 illustratively includes a rearward portion 19 engaging the dielectric 32 of the coaxial cable 30. The illustrated insulator member 18 is a monolithically formed unit. Of course, the insulator member 18 may instead comprise a two-piece unit.

A portion of the connector housing 12 and a portion of the back nut 14 include respective contacting portions defining a positive stop 29 when fully engaged. More particularly, a back end 27 of the connector housing 12 and a shoulder 27 of the back nut 14 define the positive stop 29, although it should be understood that other variations of the positive stop are possible. Indeed, the connector housing 12 may have a shoulder to engage with a front portion of the back nut 14 to define the positive stop 29.

The positive stop 29 helps prevent overtightening of the engagement between the connector housing 12 and the back nut 14 that may generate compression and or shearing forces at potentially damaging levels. The positive stop 29 therefore facilitates easy installation of the connector 10 on the coaxial cable 30 by eliminating the need for a torque wrench or other torque limiting tool.

Figure 10:
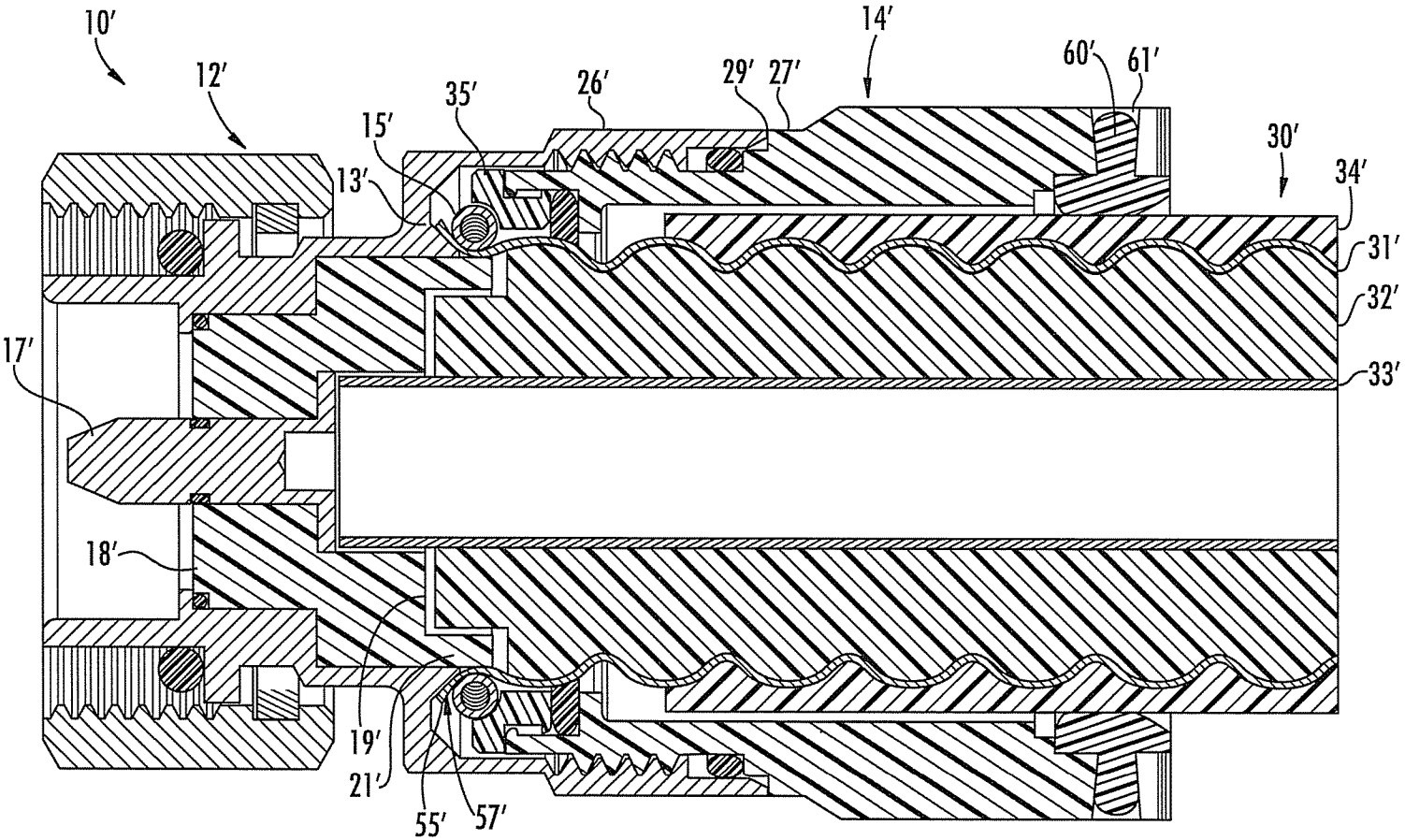
FIG. 10 is a longitudinal cross-sectional view of an alternative embodiment of a connector installed on the end of a coaxial cable having a corrugated outer conductor in accordance with the present invention.

With brief reference to FIG. 10, it should be understood that the connector 10' may also be usable with coaxial cables 30' having corrugated outer conductors 31'. Those other elements not specifically mentioned are indicated with prime notation and are similar to the elements described above with reference to FIG. 1. Accordingly, those other elements require no further description herein.

Figure 11:
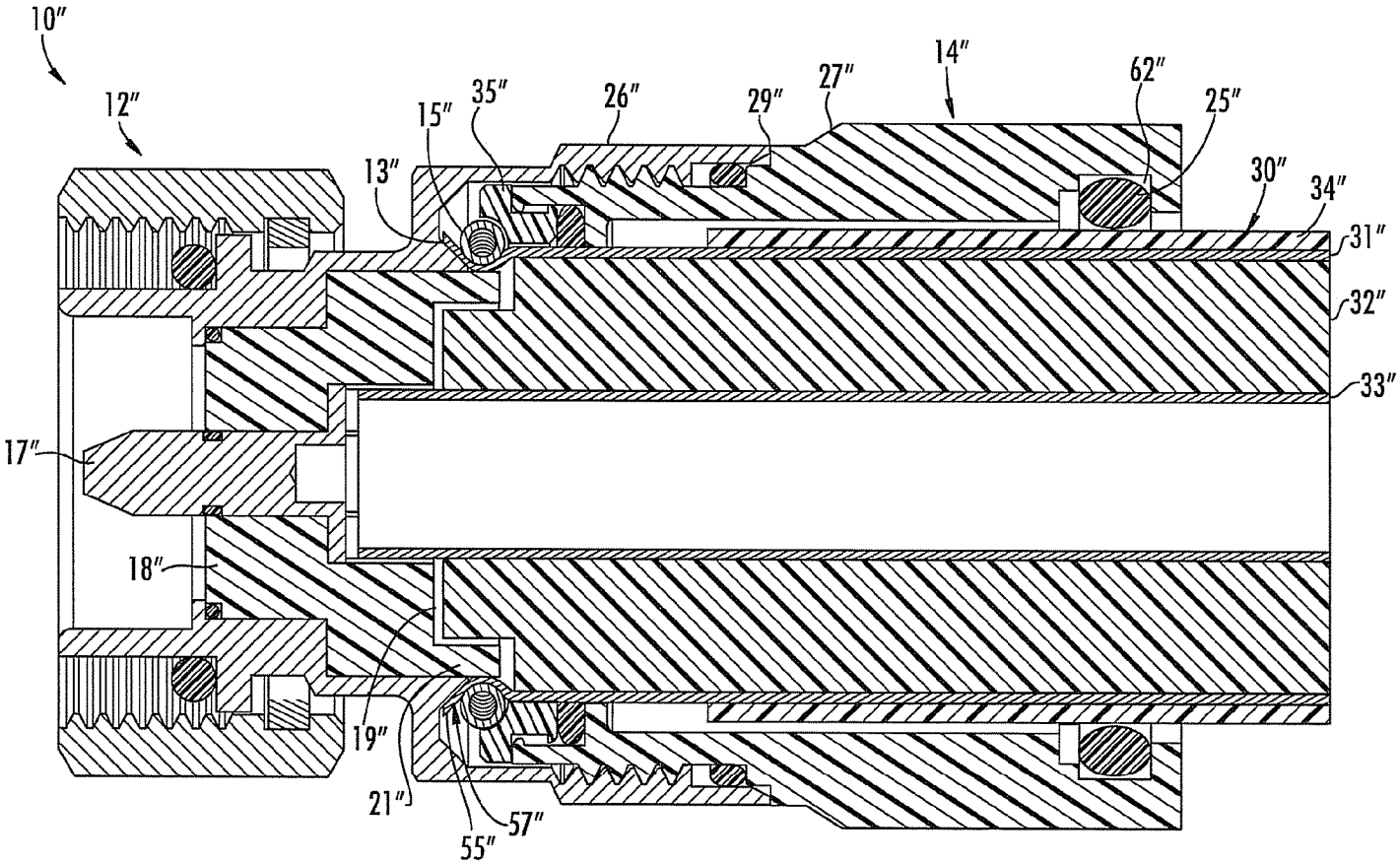
FIG. 11 is a longitudinal cross-sectional view of yet another embodiment of a connector installed on the end of a coaxial cable having a smooth outer conductor in accordance with the present invention.
Figure 12:
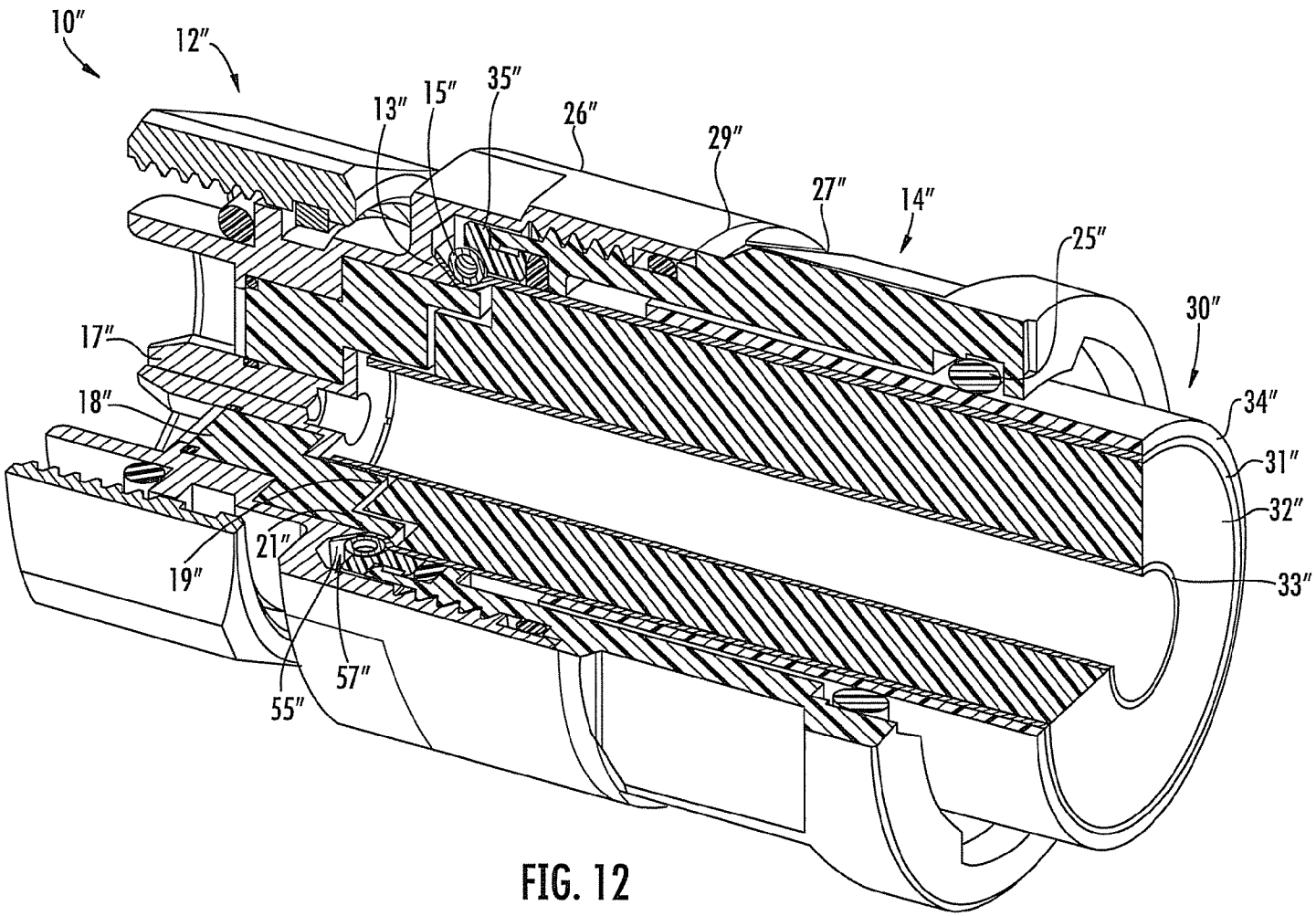
FIG. 12 is a perspective cutaway view of the connector of FIG. 11.

Additionally, with brief reference to FIG. 11-12, those skilled in the art will understand that the rearward o-ring 25" may lack a retaining projection. Instead, in such an embodiment, the rearward o-ring 25" is received by an o-ring pocket 62". Furthermore, the coaxial cable 30" illustratively has a hollow inner conductor 33" without an inner conductor dielectric. Those other elements not specifically mentioned are indicated with double prime notation and are similar to the elements described above with reference to FIG. 1. Accordingly, those other elements require no further description herein.

Figure 13:
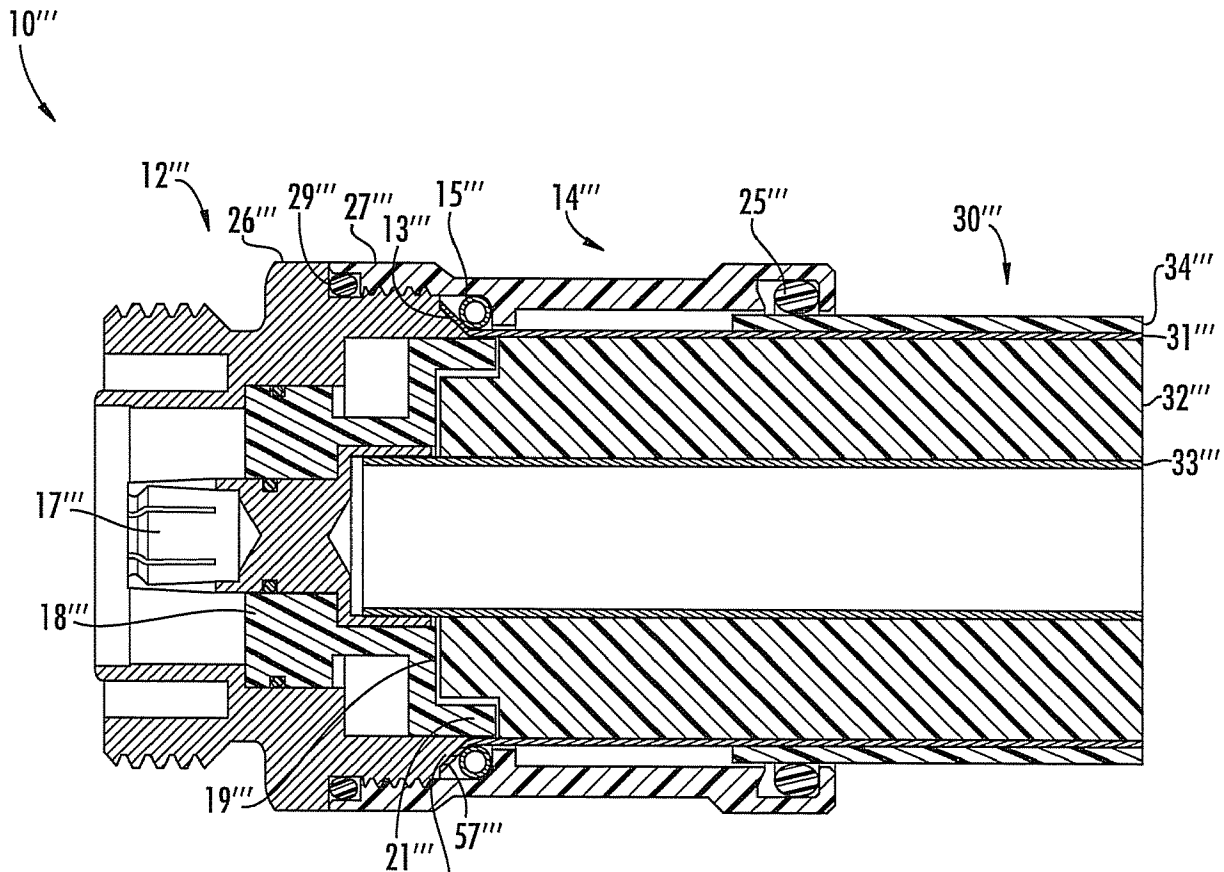
FIG. 13 is a longitudinal cross-sectional view of a further embodiment of a connector installed on the end of a coaxial cable having a smooth outer conductor in accordance with the present invention.

Skilled artisans will appreciate that further configurations of the connector housing 12 and back nut 14 may be used. For example, in an embodiment of the connector 10''' illustrated in FIG. 13, the connector housing 12" is threadingly received by the back nut 14'''. It should also be noted that in this illustrated embodiment, the outer conductor 31''' does not have a corrugated end and that the radially outer ramp 13''' is not shaped to receive such a corrugated end. Accordingly, skilled artisans will understand that such a feature is optional. Furthermore, there is no ferrule. Those other elements not specifically mentioned are indicated with triple prime notation and are similar to the elements described above with reference to FIG. 11. Accordingly, those other elements require no further description herein.

Another aspect is directed to a method of making a connector 10 to be attached to a coaxial cable 30 comprising an inner conductor 33, an outer conductor 31, and a dielectric therebetween 32. The method comprises defining a radially outer ramp 13 on a connector housing 12 to receive the outer conductor thereagainst 31 and forming a compressible ring 15 to compressibly clamp against the outer conductor opposite the radially outer ramp as the connector housing and a back nut 14 are engaged. An insulator member 18 is positioned in the connector housing 12 for carrying a center contact 17 to be coupled to the inner conductor 33 and comprising a radially outer support portion 21 to radially support the outer conductor 31 opposite the compressible ring 15.

With reference to FIGS. 14A-14B, 15A-16B, and 20, a cable end preparation tool 40 for a coaxial cable 30 is now described. It should be noted that, while the tool 40 is described herein by way of example for use with cellular tower cable installations, the tool may of course be used for cable end preparation in other applications as well.

The coaxial cable 30 comprises an inner conductor 33, an outer conductor 31, and a dielectric 32 therebetween. An optional dielectric jacket 51 surrounds the outer conductor 31. It should be appreciated that the end of the illustrated coaxial cable 30 has been prepared by the tool 40.

Although the illustrated coaxial cable 30 has a smooth outer conductor 31, it should be understood that the cable end preparation tool 40 may also be used with a coaxial cable having a corrugated outer conductor. Before using the cable end preparation tool 40, a technician will typically cut the coaxial cable 30. The coaxial cable 30 is cut so that the outer conductor 31 and dielectric 32 are flush with each other while the inner conductor 33 protrudes therebeyond.

The cable end preparation tool 40 illustratively comprises a body 41 having a central opening 42 therein. The central opening 42 may be sized according to the coaxial cable 30 size and may receive the inner conductor 33 to steady and align the tool 40 on the cable end so that the user may push the body 41 toward the cable 51 and rotate or twist it about the central axis thereof.

In the illustrated example, the body 41 is disk shaped, but other body shapes may also be used in different applications. The body 41 may be made from a variety of materials, such as metal and plastic, for example, using common manufacturing techniques known to those skilled in the art. The body may include a plurality of raised gripping surfaces 66 (knurls, for example) thereon to help facilitate gripping by the user, although a variety of textured surfaces or other gripping features (e.g. dimples, grooves, etc) may also be used, if desired, but such gripping features are in no way required.

A blade 43 is carried by the body and is for removing a portion of the dielectric 32 between the inner conductor and the outer conductor when the body 41 is rotated about the coaxial cable 30. The removal of the portion of the dielectric 32 occurs when the user rotates the body 41 by hand and pushes the body toward the cable 30.

It should be noted that the blade 43 need not necessarily strip all of the dielectric 32 from the outer conductor 31 and the inner conductor 33 in all applications. That is, a residual amount of dielectric material may remain on the outer conductor 31 and the inner conductor 33, which may be cleaned off by hand if desired. Skilled artisans will recognize that there may be an adhesive layer between the outer conductor 31 and the dielectric 32 and that a residual amount of this adhesive layer may remain after the blade 43 is used to strip the dielectric from the outer conductor. The body 42 also illustratively includes a blade access opening 48, which not only allows cuttings to pass through the cable end preparation tool 40 but may also allow the blade to be removed and/or replaced, if desired.

Figure 23:
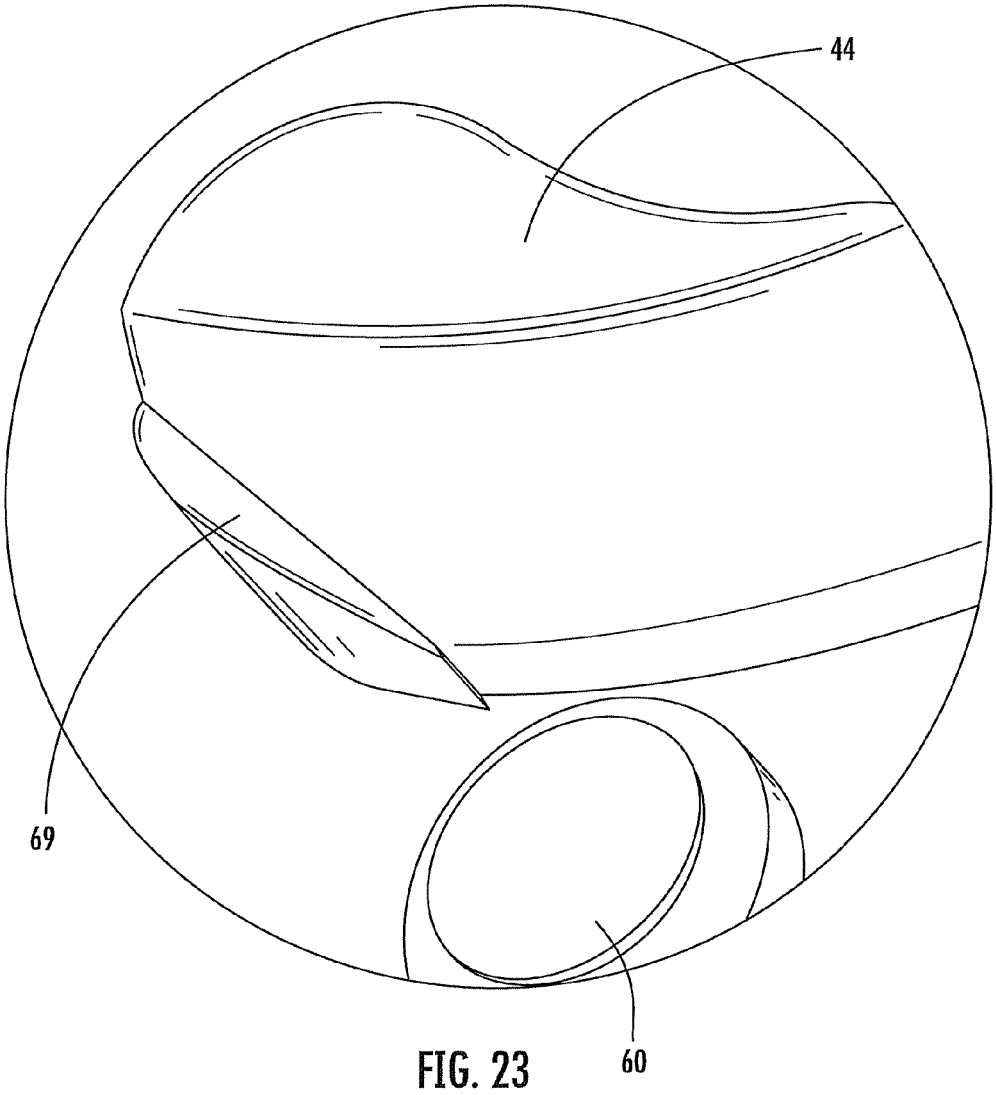
FIG. 23 is a greatly enlarged perspective view of the first projection of the cable preparation tool of FIGS. 14A-14B.

The tool includes a first projection 44 (FIG. 23) carried by the body 41 and having a predetermined shape for flaring an end portion of the outer conductor 55 when the body is rotated relative to the coaxial cable 30. The first projection 44 has an outwardly extending portion 69 having a predetermined shape for beginning flaring of an end portion of the outer conductor 31 when the body 41 is rotated relative to the coaxial cable 30. Furthermore, as the user rotates the body 41 and pushes the body toward the cable 30, the first projection 44 continues causing the outer conductor 31 to flare outwardly. The result of this flaring is perhaps best shown by the flared end 55 of the coaxial cable 30 in FIG. 20. Of course, the first projection 44 need not have the outwardly extending portion 69 in all applications.

It should be understood that the predetermined shape of the first projection 44 may also remove at least a portion of a residual adhesive layer from the outer conductor 31 as the body 41 is rotated relative to the coaxial cable 30. The removal of this adhesive layer may enhance an electrical contact made between the outer conductor 31 and a connector.

A stabilizing projection 60 extends outwardly from the body 41. The stabilizing projection 60 receives the jacket 34 of the coaxial cable 30 thereagainst during use of the tool 40. This stabilizing projection 60 helps to stabilize the tool 40 as it is rotated about the coaxial cable 30.

Figure 14A:
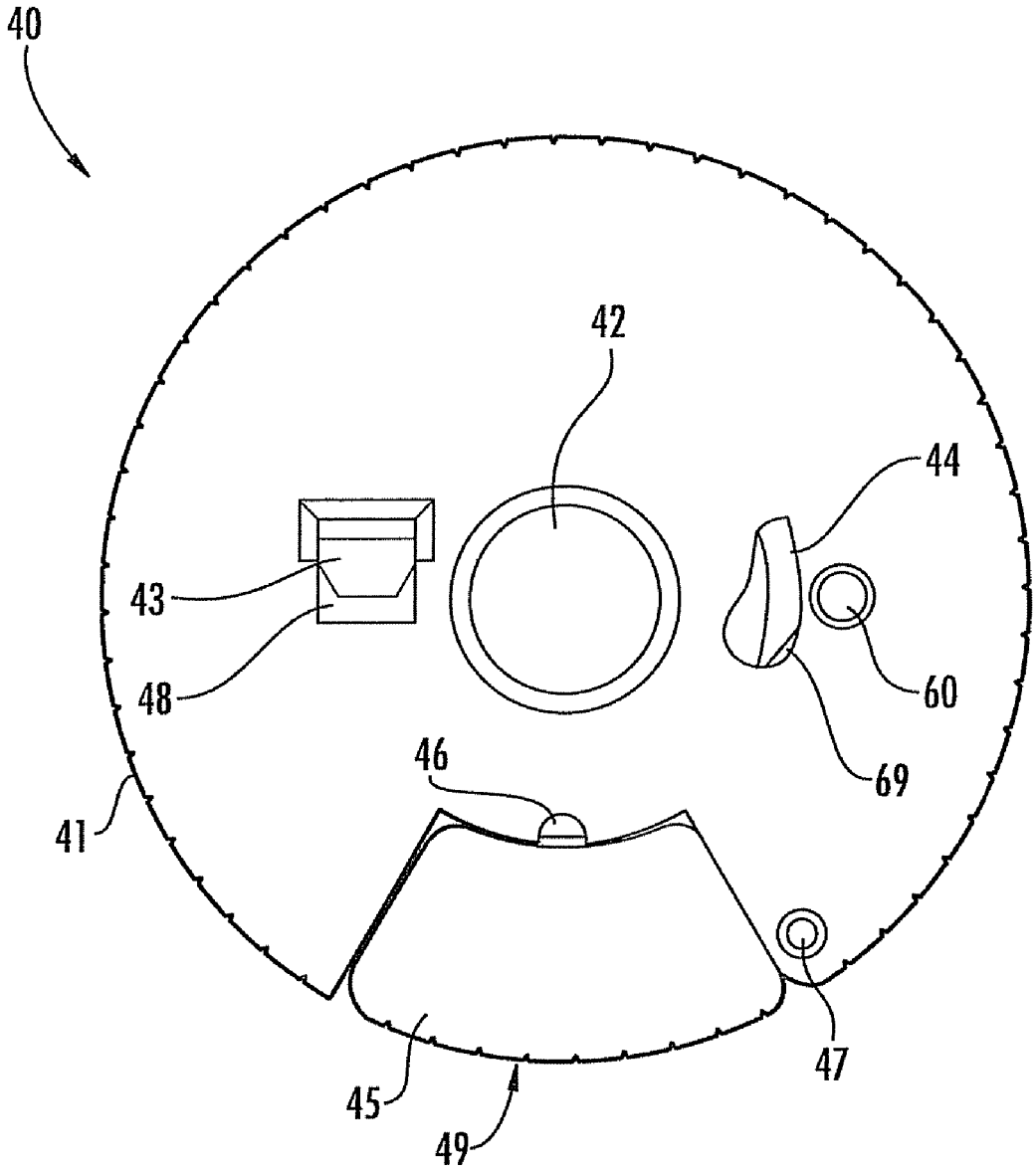
FIG. 14A is front elevational view of a first embodiment of a cable preparation tool for a coaxial cable having a projection being in an outer conductor engaging position, in accordance with the present invention.
Figure 14B:
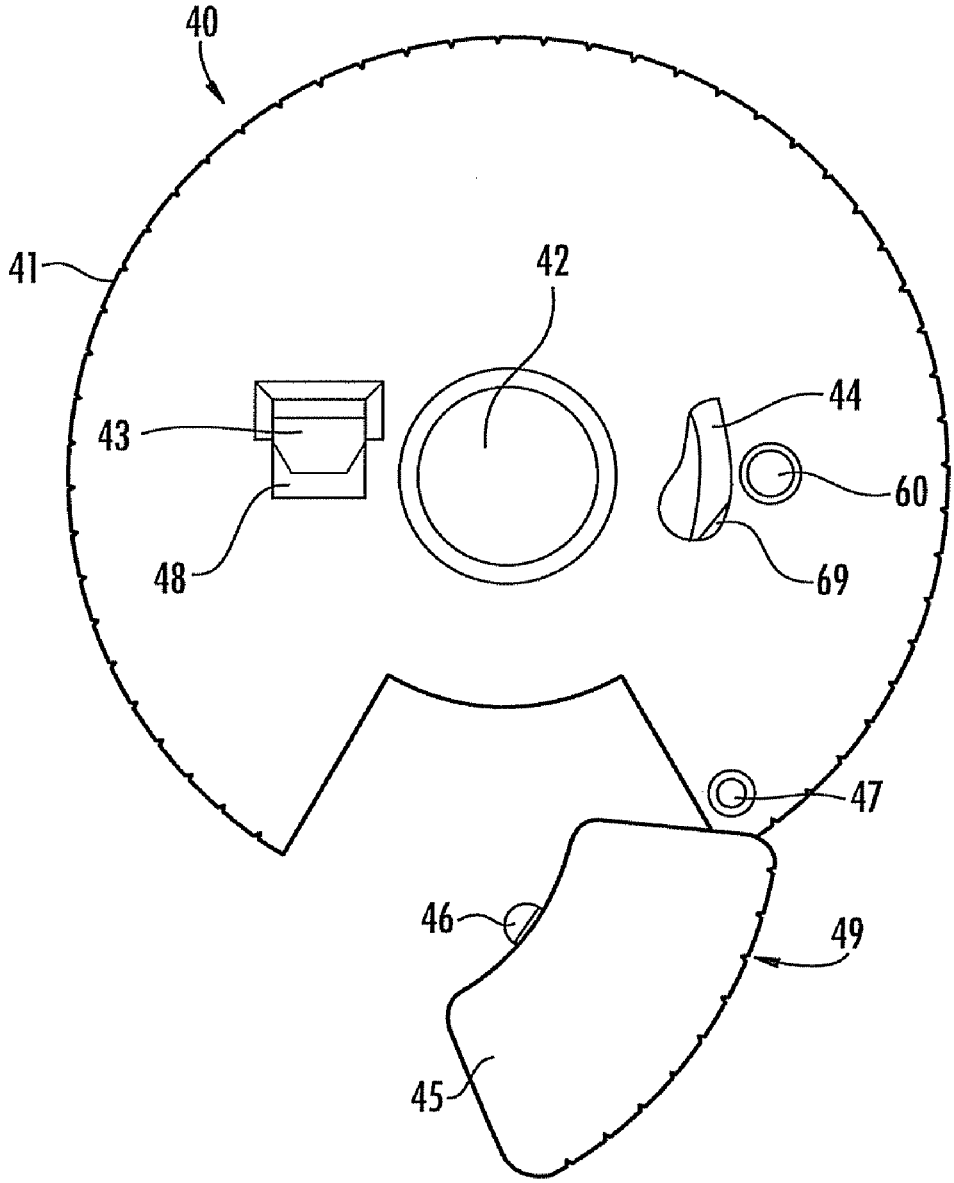
FIG. 14B is a front elevational view of the cable preparation tool of FIG. 14A with the projection in a disengaged position.

The tool 40 also includes a second projection 49 being movable with respect to the body 41 between an outer conductor engaging position (shown in FIG. 14A) and a disengaged position (shown in FIG. 14B). The second projection 49 comprises a base 45 and a forming tip 46 carried thereby. The base 45 is pivotally connected to the body 41 by a hinge pin 47. Of course, it should be appreciated that the base 45 could be connected to the body 41 in other suitable fashions. For example, the base 45 and the second projection 49 can be integrally formed as a monolithic unit and the base may be coupled to the second projection by a tab.

The forming tip 46 corrugates the flared end portion 55 of the outer conductor 31 when the base 46 is in the outer conductor engaging position and the body 41 is rotated relative to the coaxial cable 30. This corrugation results in a corrugated portion 56 of the coaxial cable 30 having a diameter less than that of the outer conductor 31. This advantageously prepares a coaxial cable 30 with a smooth outer conductor 31 to be used with a connector designed for use with a coaxial cable having a corrugated outer conductor. The skilled artisan will understand that corrugating may not be required in certain implementations depending upon the given cable and connector type, and thus in such applications use of the second projection 49 may not be required.

In some applications, at least one of the blade 43, first projection 44, and second projection 49 may be removably mounted to the body 41. This may allow for the replacement of the blade 43, first projection 44, and second projection 49 if one thereof becomes damaged or worn. Further, this may allow for the blade 43 to be removed, sharpened, then reattached to the body 41.

In the illustrated embodiment, the blade 43, first projection 44, and second projection 49 are each on a same side of the body 41. However, it should be recognized that each of the blade 43, first projection 44, and second projection 49 need not each be on a same side of the body 41.

Figure 15B:
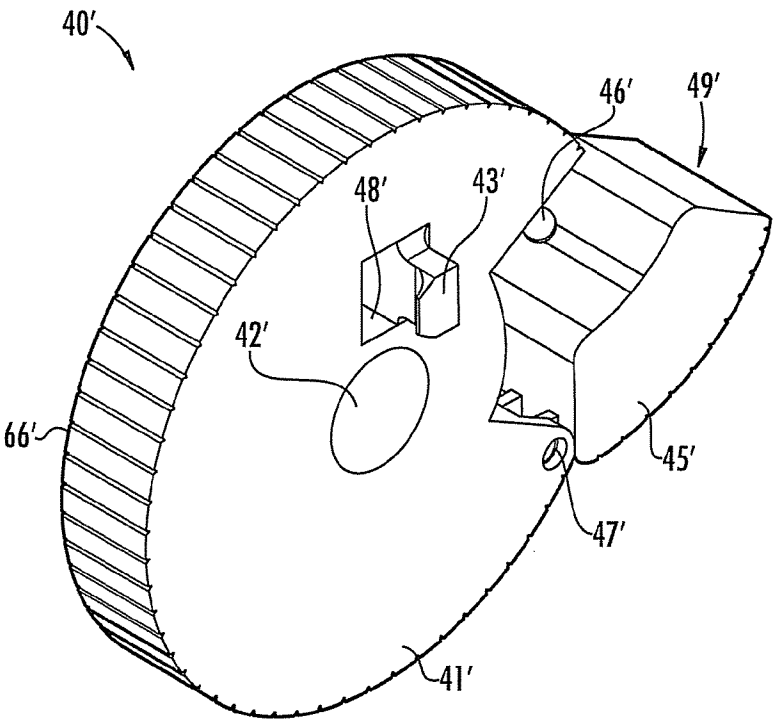
FIG. 15B is a rear perspective view of the cable preparation tool of FIG. 15A.
Figure 15A:
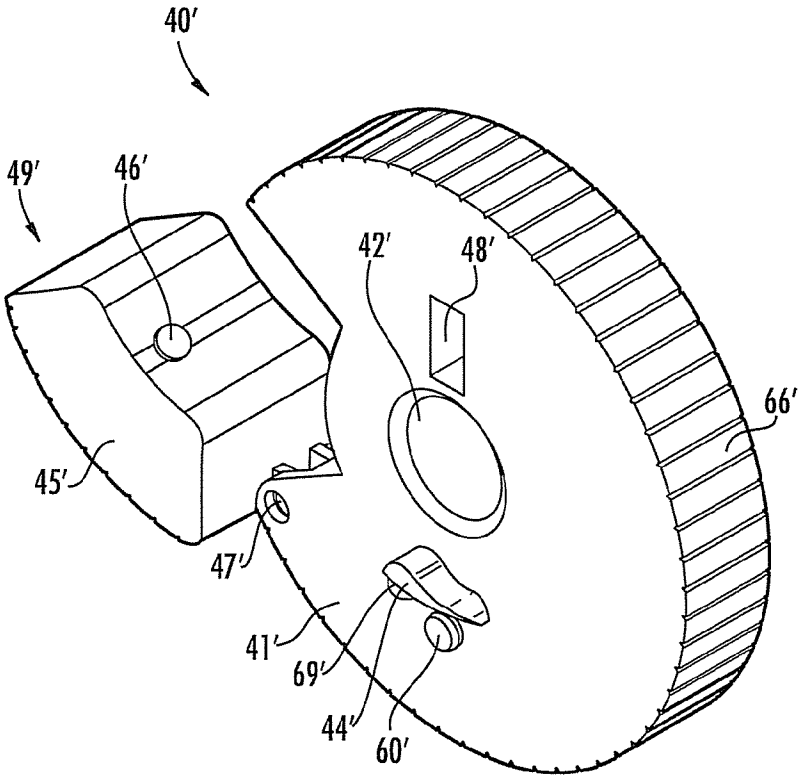
FIG. 15A is a front perspective view of an alternative embodiment of a cable preparation tool for a coaxial cable, in accordance with the present invention.
Figure 16:
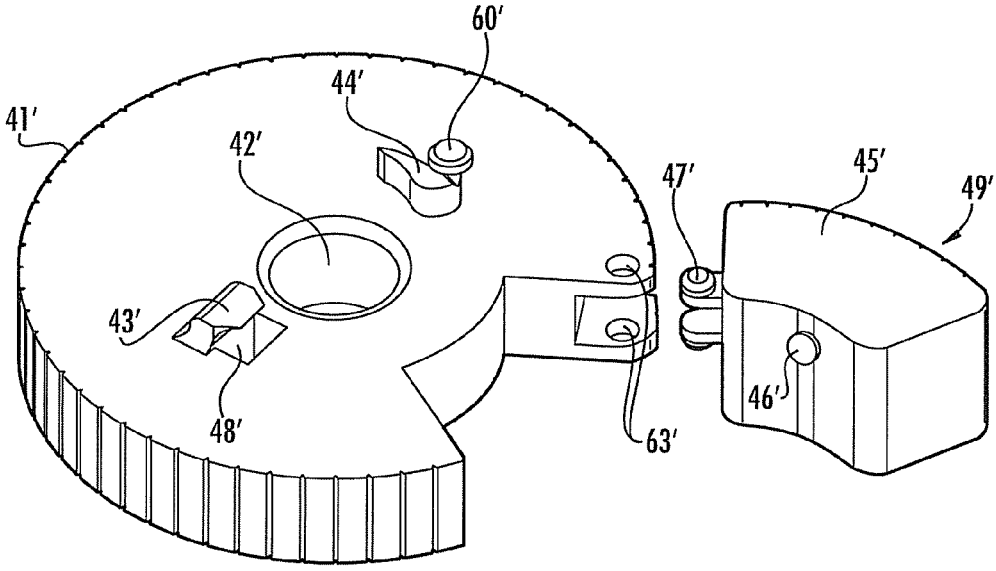
FIG. 16 is a front perspective view of the cable preparation tool of FIGS. 15A-15B wherein the second projection is detached from the body of the cable preparation tool.

Indeed, FIGS. 15A and 15B illustrate an alternative embodiment of the cable end preparation tool 40' where the first projection 44' and second projection 49' are each on carried by a first side 57' of the body 41'. The blade 43' is carried by a second side 58' of the body. This may advantageously allow the dielectric removal and flaring functions of the tool 40' to be performed at separate times. As shown in FIG. 16, rather than a hinge pin, a pair of hinge tabs 47' may extend radially inwardly from the second projection 49'. These hinge tabs 47' are received by hinge tab receiver holes 63' defined in the body 41' of the tool 40'.

Figure 17:
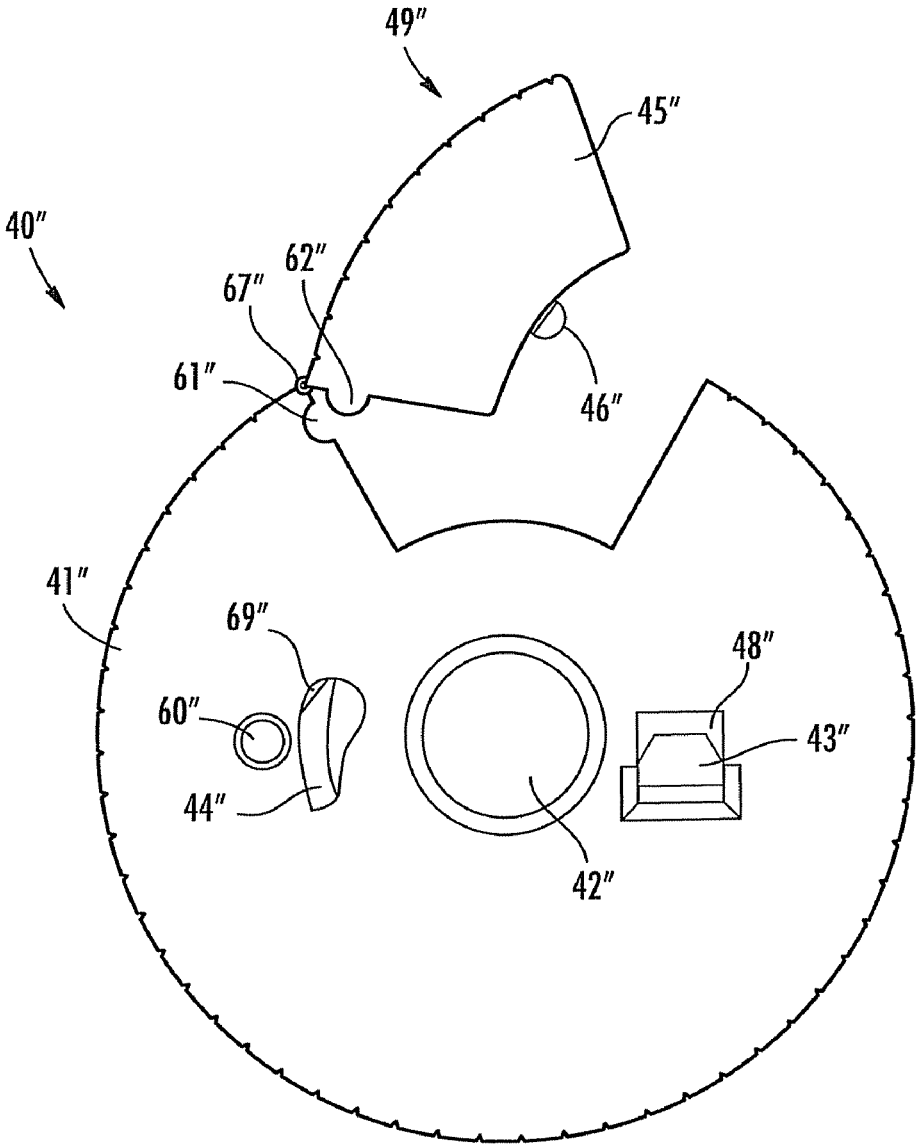
FIG. 17 is a front elevational view of a further embodiment of a cable preparation tool wherein the second projection is attached to the body of the cable preparation tool by a flexible strap, in accordance with the present invention.

With brief reference to FIG. 17, an embodiment of the tool 10" without a hinge pin is described. Rather, the body 41", the blade 43", the first projection 44", and the second projection 49" are integrally formed as a monolithic unit. A flexible strap 67" connects the second projection 49" to the body 41". Furthermore, a stress relieving projection 62" extends outwardly from the second projection 49". This stress relieving projection 62" is received by a groove 61" defined in the body 41" of the tool 40" and reduces stress on the flexible strap 67" when a technician is using the tool 40" to corrugate a coaxial cable.

Figure 18:
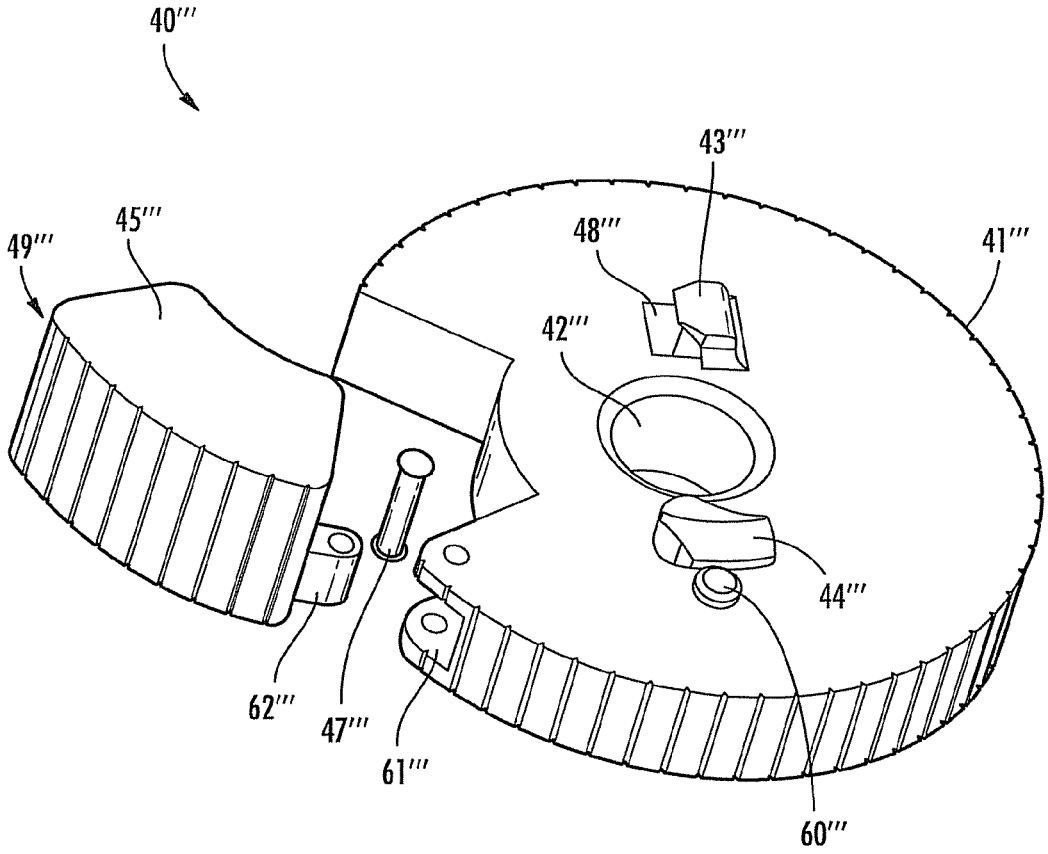
FIG. 18 is a front perspective view of yet another embodiment of a cable preparation tool wherein the second projection is detached from the body of the cable preparation tool, in accordance with the present invention.

Shown in FIG. 18 is an embodiment of the tool 40''' where the body has a retaining groove 61''' defined therein. A retaining projection 62''' extends outwardly from the second projection 49'''. The hinge pin 47''' extends through holes in the retaining groove 61''' and retaining projection 62''' to thereby secure the second projection 49''' to the body 41''' of the tool 40'''.

Figure 19:
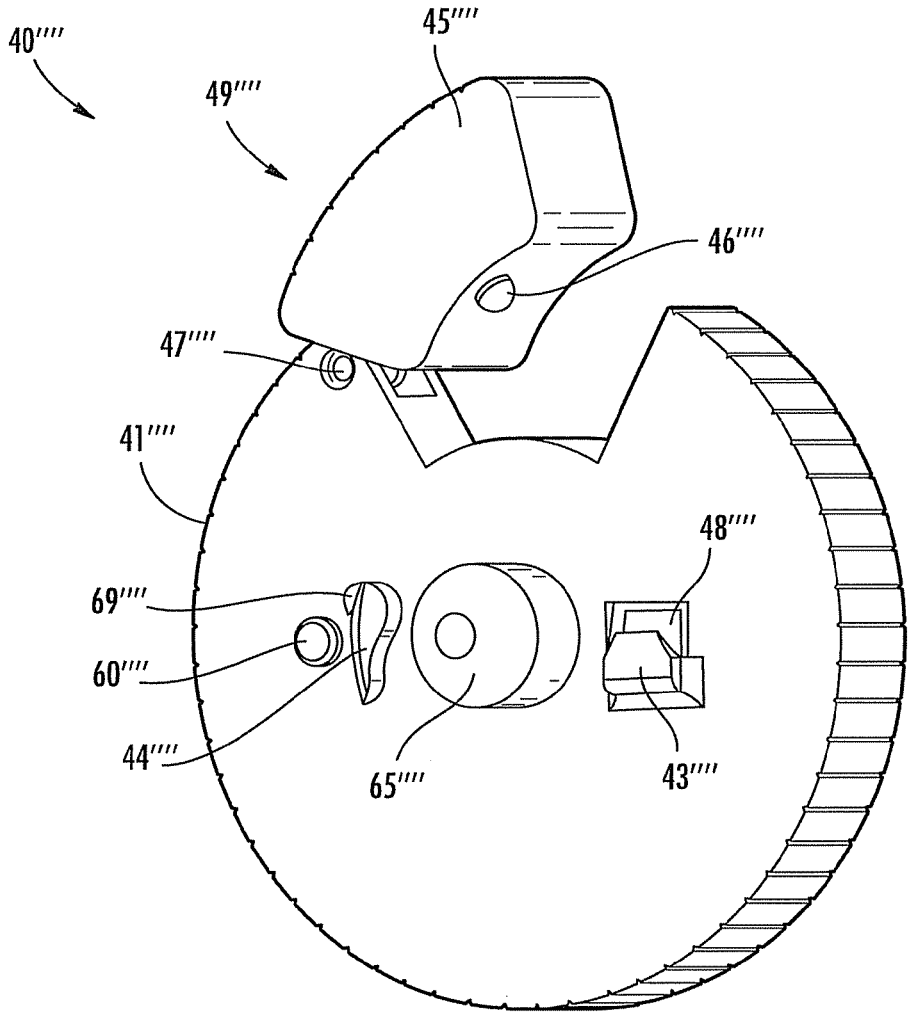
FIG. 19 is a front perspective view of still another embodiment of a cable preparation tool in accordance with the present invention.
Figure 20:
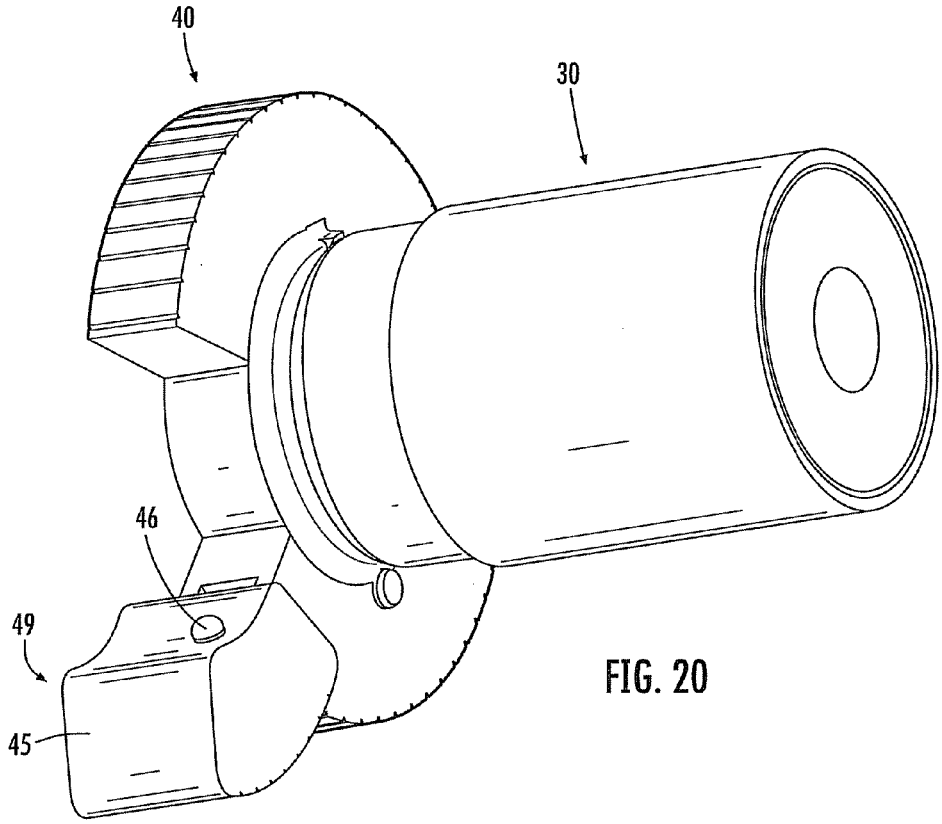
FIG. 20 is a perspective view of the cable preparation tool of FIGS. 14A-14B installed on the end of a coaxial cable.
Figure 21:
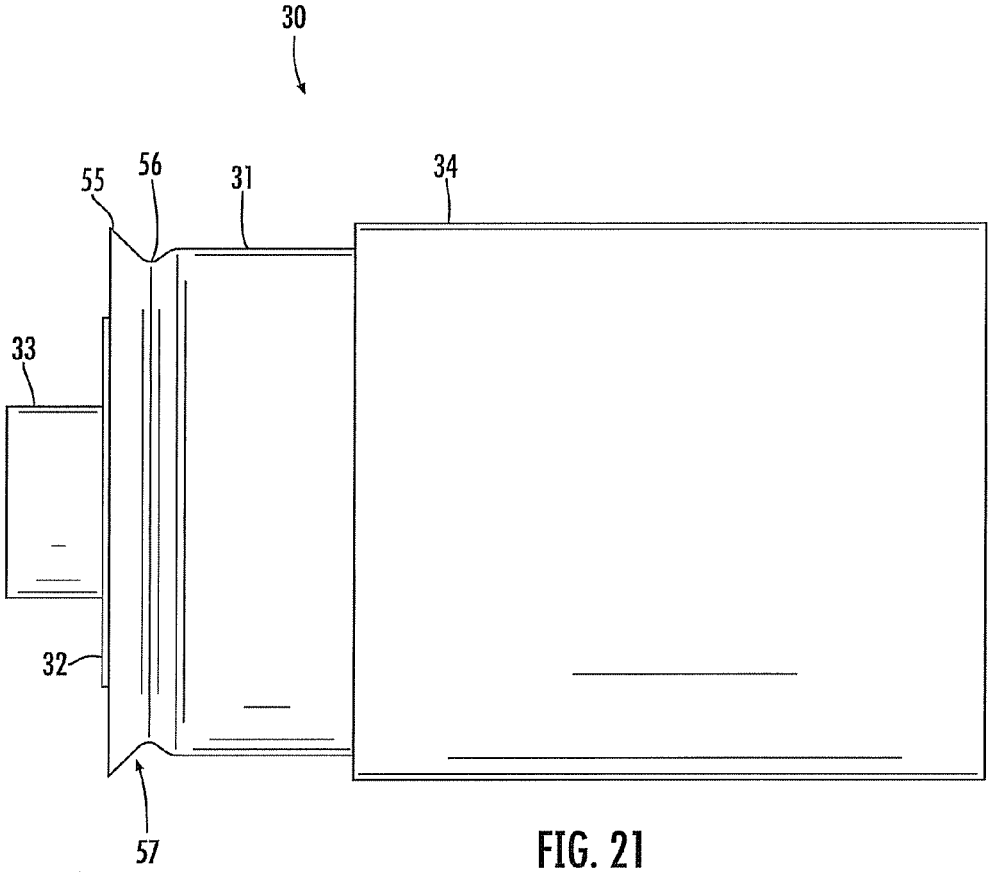
FIG. 21 is a side view of the coaxial cable of FIG. 1 as prepared by the cable preparation tool of the present invention.
Figure 22:
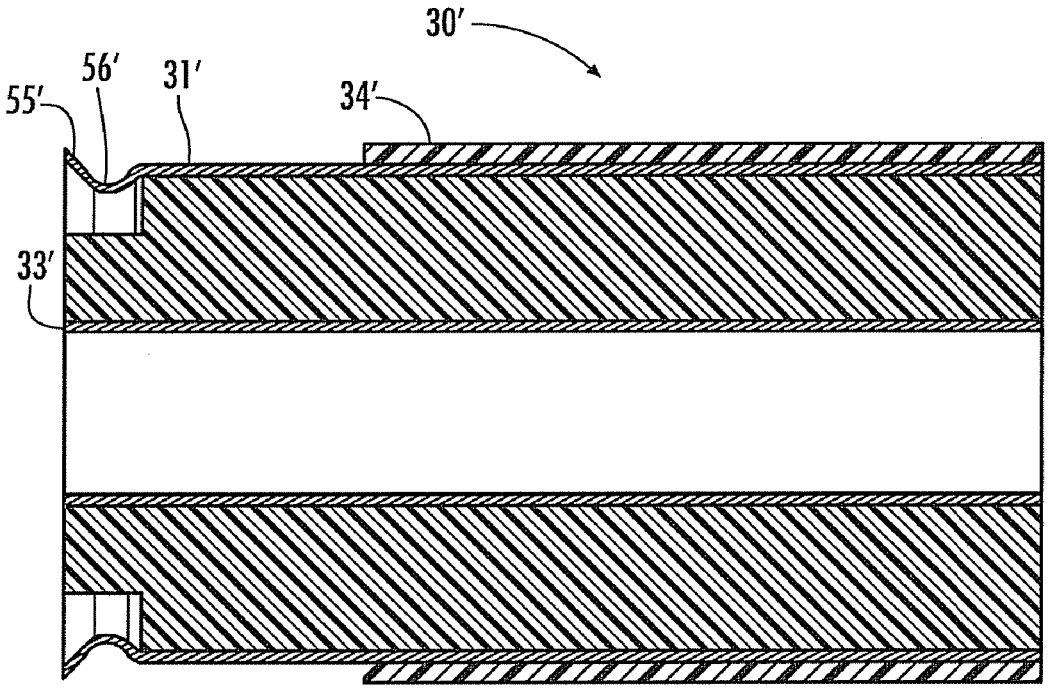
FIG. 22 is a side view of a coaxial cable having a hollow inner conductor as prepared by the cable preparation tool shown in FIG. 19.

Yet another embodiment is shown in FIG. 19. In this embodiment, rather than having a central hole, the body 41'''' carries a central rotation guide 65''''. The central rotation guide 65'''' is to be inserted into a hollow inner conductor 33' (FIG. 22). Once the central rotation guide 65'''' is inserted into the hollow inner conductor 33', the tool 40'''' may be rotated about the coaxial cable 30'. The central rotation guide 65'''' provides support to the inner conductor 33' so that it is not bent or crushes during preparation of the coaxial cable 30'.

With reference to FIGS. 1, 15A, 15B, and 21, a method of preparing a coaxial cable 30 with a cable end preparation tool 40' for use with a connector 10 is now described. First, a technician will typically cut the coaxial cable 30. The coaxial cable 30 may be cut flush, although preferably may be cut so that the outer conductor 31 and dielectric 32 are flush with each other while the inner conductor 33 protrudes therebeyond. The back nut 14 of the connector 10 is then positioned on the coaxial cable 30 and slid away from the cable end.

The inner conductor 33 of the coaxial cable 30 is then inserted into the central opening 42' of the tool 40' so that the second side 58' of the tool is facing the cable end. The body 41' of the tool 40' is then rotated with respect to the cable 30 to thereby remove a portion of the dielectric 32 between the inner conductor 33 and the outer conductor 31.

The tool 40' is then removed from the inner conductor 33 of the cable 30 and replaced on the inner conductor with the first end 57' of the body 41' facing the cable end. The body 41' of the tool 40' is then rotated with respect to the cable 30 to flare an end portion of the outer conductor (see flared end portion 55 of FIG. 6). Furthermore, the second projection 49' of the tool 30' is set to the outer conductor engaging position and the body 41' is rotated with respect to the cable to corrugate the flared end portion 55 of the outer conductor 31 (see corrugation 56 of FIG. 21).

The connector housing 12 is then inserted onto the cable end so that the flared portion 55 of the coaxial cable 30 is positioned adjacent the radially outer ramp 13 and the radially outer support portion 21 of the insulator member 18 is supporting the outer conductor 31. The back nut back nut 14 is then threaded into the connector housing 12 until the positive stop 29 therebetween is engaged. As the back nut 14 is threaded into the connector housing 12, the compressible ring 15 compressibly clamps against the outer conductor 31 opposite the radially outer ramp 13. Of course, those skilled in the art will recognize that the connector 10 and tool 40' as described in this method may have any or all of the features described hereinbefore.

Referring again to FIGS. 14A and 14B, a method aspect is directed to a method of preparing an end of a coaxial cable 30 comprising an inner conductor 31, an outer conductor 33, and a dielectric 32 therebetween, using a cable end preparation tool 40. The method comprises positioning the cable end preparation tool 40 adjacent the coaxial cable 30 end and removing a portion of the dielectric 32 with a blade 43 carried by a body 41 of the cable end preparation tool by rotating the body relative to the coaxial cable. Further, the method includes flaring an end portion of the outer conductor 31 with a first projection 44 carried by the body 41 by rotating the body relative to the coaxial cable 30. In addition, the method includes corrugating the flared end portion of the outer conductor 31 with a second projection 49 carried by the body 41 and being movable with respect to the body between an outer conductor engaging position and a disengaged position by rotating the body relative to the coaxial cable 30 when the second projection is in the outer conductor engaging position.

Other details of such connectors 10 for coaxial cables 30 may be found in co-pending applications CONNECTOR WITH POSITIVE STOP FOR COAXIAL CABLE AND ASSOCIATED METHODS, CONNECTOR INCLUDING COMPRESSIBLE RING FOR COAXIAL CABLE AND ASSOCIATED METHODS, CONNECTOR WITH POSITIVE STOP AND COMPRESSIBLE RING FOR COAXIAL CABLE AND ASSOCIATED METHODS, and CONNECTOR WITH RETAINING RING FOR COAXIAL CABLE AND ASSOCIATED METHODS, the entire disclosures of which are hereby incorporated by reference.

Many modifications and other embodiments of the invention will come to the mind of one skilled in the art having the benefit of the teachings presented in the foregoing descriptions and the associated drawings. Therefore, it is understood that the invention is not to be limited to the specific embodiments disclosed, and that modifications and embodiments are intended to be included within the scope of the appended claims.

That which is claimed is:

1. A cable end preparation tool for a coaxial cable comprising an inner conductor, an outer conductor, and a dielectric therebetween, the cable end preparation tool comprising:

a body;

a blade carried by said body for removing a portion of the dielectric between the inner conductor and the outer conductor when said body is rotated about the coaxial cable;

a first projection carried by said body, spaced apart from said blade, and having a predetermined shape for flaring an end portion of the outer conductor when said body is rotated relative to the coaxial cable; and a second projection being movable with respect to said body and said blade between an outer conductor engaging position and a disengaged position, said second projection for corrugating the flared end portion of the outer conductor when in the outer conductor engaging position and said body is rotated relative to the coaxial cable.

2. The cable end preparation tool of claim 1 wherein said second projection comprises a base and a forming tip carried thereby; and wherein said base is pivotally connected to said body.

3. The cable end preparation tool of claim 1 wherein said first projection has an outwardly extending portion having a predetermined shape for beginning flaring of an end portion of the outer conductor when said body is rotated relative to the coaxial cable.

4. The cable end preparation tool of claim 1 wherein said body has a disk shape.

5. The cable end preparation tool of claim 4 wherein said body has a central opening therein.

6. The cable end preparation tool of claim 4 further comprising a central rotation guide carried by said body.

7. The cable end preparation tool of claim 4 wherein said body has first and second opposing sides; and wherein said blade and said first projection are carried by the first side.

8. The cable end preparation tool of claim 4 wherein said body has first and second opposing sides; wherein said blade is carried by the first side; and wherein said first projection is carried by the second side.

9. The cable end preparation tool of claim 1 wherein said body has a blade access opening defined therein adjacent said cutting blade for receiving the portion of the dielectric between the inner conductor and the outer conductor removed by said cutting blade.

10. The cable end preparation claim 1 wherein the coaxial cable further comprises an adhesive layer between the outer conductor and the dielectric; and wherein said first projection is also for removing a portion of an adhesive layer between the outer conductor and the dielectric of the coaxial cable when said body is rotated relative to the coaxial cable.

11. The cable end preparation tool of claim 1 wherein said blade, first projection, and second projection are removably mounted to said body.

12. The cable end preparation tool of claim 1 wherein said body, said blade, said first projection, and said second projection are integrally formed as a monolithic unit.

13. The cable end preparation tool of claim 1 wherein the body has a gripping surface.

* * * * *